US006289680B1

(12) United States Patent
Oh et al.

(10) Patent No.: US 6,289,680 B1
(45) Date of Patent: Sep. 18, 2001

(54) APPARATUS FOR CONTROLLING LINEAR COMPRESSOR AND METHOD THEREOF

(75) Inventors: Ki Tae Oh, Kyungki-Do; Joo Wan Kim, Seoul, both of (KR)

(73) Assignee: LG Electronics, Inc. (KR)

( * ) Notice: Subject to any disclaimer, the term of this patent is extended or adjusted under 35 U.S.C. 154(b) by 0 days.

(21) Appl. No.: 09/433,426

(22) Filed: Nov. 4, 1999

(30) Foreign Application Priority Data

| | | |
|---|---|---|
| Nov. 4, 1998 | (KR) | 98-47108 |
| Nov. 4, 1998 | (KR) | 98-47109 |
| Oct. 26, 1999 | (KR) | 99-46588 |
| Oct. 26, 1999 | (KR) | 99-46589 |

(51) Int. Cl.[7] ..... F25B 9/00; F04B 49/06
(52) U.S. Cl. ..... 62/6; 62/228.3; 417/45
(58) Field of Search ..... 62/6, 228.3; 60/520; 417/45; 361/24

(56) References Cited

U.S. PATENT DOCUMENTS

| | | | | |
|---|---|---|---|---|
| 5,752,385 | * | 5/1998 | Nelson | 62/6 |
| 5,809,792 | * | 9/1998 | Song | 62/115 |
| 5,980,211 | * | 11/1999 | Tojo et al. | 417/45 |

* cited by examiner

*Primary Examiner*—William Wayner
(74) *Attorney, Agent, or Firm*—Ostrolenk, Faber, Gerb & Soffen, LLP

(57) ABSTRACT

An apparatus for controlling an operation of a linear compressor by which an instablel phenomenon caused due to a characteristics deviation of parts of a compressor is corrected to stabilize the operation of the system, thereby accomplishing an optimal operation. Also, when the tuning instability occurs due to the characteristic deviation and the assembly deviation of the mechanic unit of the compressor, and the parts deviation in the control circuit such as the sensorless stroke estimator, the compressor deviation is corrected by using a relative coordinate value. And, while the linear compressor is being operated with the stroke command value according to the cooling mode, in case that the current stroke is in an unstable state, the stroke command value is lowered down as much as a predetermined value, with which the linear compressor is operated for a predetermined time. Then, when a predetermined time lapses, it is operated with the original stroke command value, thereby evading the instablel state. In addition, the tuning instability region is searched for depending on the discharge side pressure and the suction side pressure of the compressor or the outer air temperature while the linear compressor is being operated, in order to avoid it, thereby accomplishing the optimal operation of the linear compressor.

14 Claims, 16 Drawing Sheets

FIG. 2A
CONVENTIONAL ART
FIG. 2B
CONVENTIONAL ART
FIG. 2C
CONVENTIONAL ART
FIG. 2D
CONVENTIONAL ART
FIG. 2E
CONVENTIONAL ART
FIG. 2F
CONVENTIONAL ART
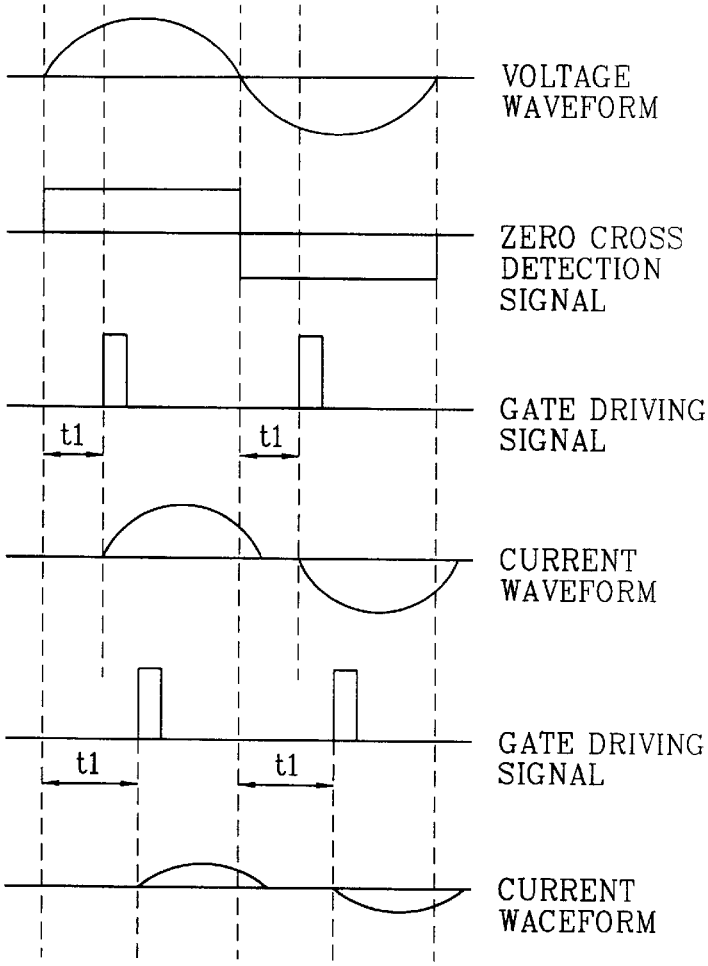
FIG. 3
CONVENTIONAL ART
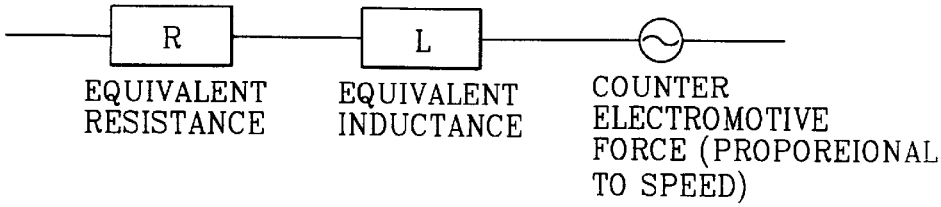

$$i_0 = -\frac{R_2}{R_1 R_3} V_m + \frac{Ro}{Rs} im + R_0 C_s \frac{dim}{dt}$$

$$R_4^2 C_1 C_2 \frac{d^2 Vo}{dt^2} + 2R_4 C_1 \frac{dV_0}{dt} + Vo = -(2R_4 i_0 + R_4^2 C_2 \frac{di_0}{dt})$$

FIG. 19
| | ABSOLUTE CORDINATE METHOD | RELATIVE CORDINATE METHOD USING SELF TUNING |
|---|---|---|
| COOLING MODE 1 | 2.70V | Sc−0.55V |
| COOLING MODE 2 | 3.85V | Sc−0.40v |
| COOLING MODE 3 | 3.00V | Sc−0.25V |
| COOLING MODE 4 | 3.15V | Sc−0.10V |
FIG. 20A
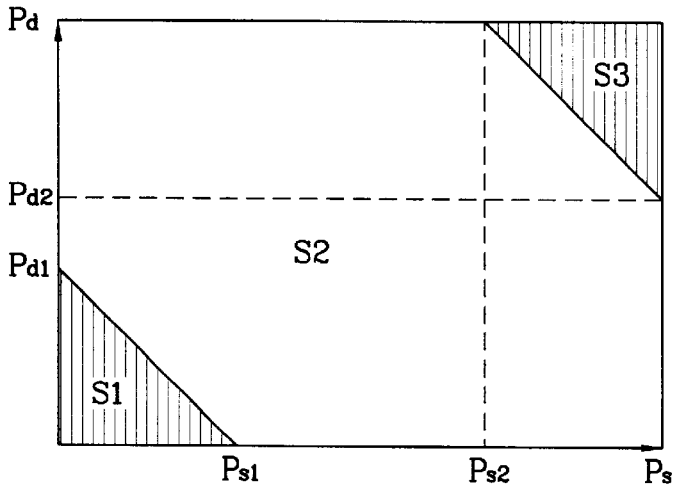
FIG. 20B
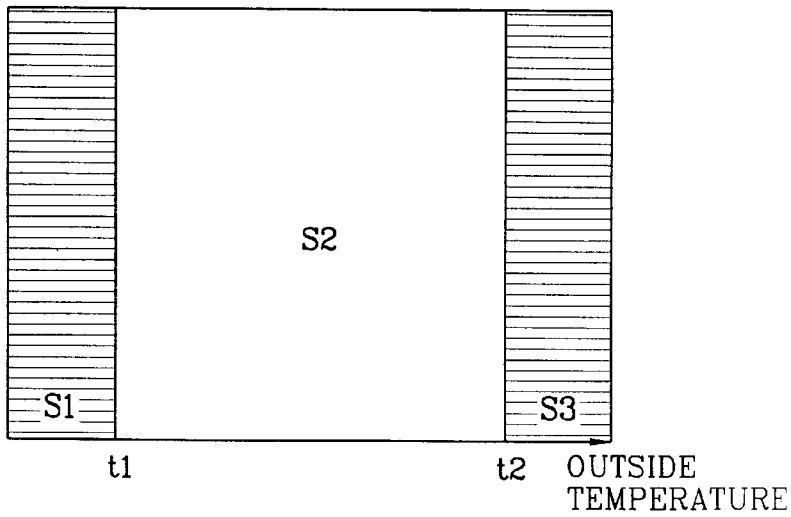

APPARATUS FOR CONTROLLING LINEAR COMPRESSOR AND METHOD THEREOF

BACKGROUND OF THE INVENTION

1. Field of the Invention

The present invention relates to an apparatus for controlling an operation of a linear compressor, and more particularly, to an apparatus for controlling an operation of a linear compressor by which an unstable phenomenon caused due to a characteristics deviation of parts of a compressor is corrected to stabilize the operation of the system, thereby accomplishing an optimal operation, and to its method.

2. Description of the Background Art

A linear compressor is driven by a linear oscillating motor, without requiring a crank shaft which changes a rotational movement to a linear movement, so that there is little frictional loss. For this reason, the linear compressor is known to have a high efficiency compared to any other compressor.

Moreover, where the linear compressor is used for a refrigerator or an air-conditioner, since a compression ratio thereof can be varied by varying a stroke of a motor, it is suitably used for a variable cooling controlling.

The construction of a linear compressor in use for the refrigerator or the air-conditioner will now be described.

FIG. 1 is a schematic block diagram of an apparatus for controlling a linear compressor in accordance with a conventional art, which includes a linear oscillating motor 10 for controlling the strength of cooling air by varying a stroke relying on an up/down movement of a piston; an electric circuit unit 20 for controlling an alternate current power source in accordance with a gate control signal so as to control a power supplied to the linear oscillating motor 10; and a control unit 30 for controlling a stroke command value according to inputted temperature information and a stroke estimated by a stroke voltage applied to the linear oscillating motor 10, to be identical to each other, and providing a thusly obtained timer drive signal to the electric circuit unit 20.

The control unit 30 includes a stroke command value determiner 31 for determining a stroke command value corresponding to a temperature upon receipt of the temperature information, and outputting it; a sensorless stroke estimator for receiving stroke voltages V0–V3 provided by the linear oscillating motor, estimating its stroke value and outputting the estimated stroke value; a stroke controller for controlling in a way that the stroke estimated in the sensorless stroke estimator 32 is suitable to the stroke command value determined by the stroke command value determiner 31, and accordingly outputting a timer command value; a zero-cross detector 34 for detecting a zero-cross point from an inputted voltage waveform and outputting a zero-cross signal; and a timer 35 for providing a gate drive signal in accordance with an estimated value estimated by the stroke controller 33 at the time when the zero-cross signal is outputted from the zero-cross detector 34.

The operation of the apparatus for controlling a linear compressor in accordance with a conventional art constructed as described above will now be described.

A power supply voltage as shown in FIG. 2A is applied from a power supply voltage terminal, it is provided to the linear oscillating motor 10 through a current sensing resistance R, a triac Tr and a capacitor C of the electric circuit unit 20, and that way, the current flows to the linear oscillating motor 10. Thereafter, a piston 11 of the linear oscillating motor 10 performs a reciprocal movement, of which reciprocal stroke distance of the piston 11 refers to a stroke. A strength of cooling air can be varied by varying the stroke, that is the strength of cooling air of the refrigerator or the air-conditioner is controlled by varying the stroke.

When a user sets a temperature of the refrigerator or the air-conditioner, information relating to set temperature is received by the stroke command value determiner 31 of the control unit 30. Upon receipt of the temperature information, the stroke command value determiner 31 determines a stroke command value corresponding to the set temperature and provides a signal of thusly determined stroke command value to the stroke controller 33.

At this time, the sensorless stroke estimator 32 receives from the linear oscillating motor 10 the voltage V0 between the current sensing resistance R and the power supply voltage terminal, the voltage V1 between the current sensing resistance R and the triac Tr, the voltage V2 supplied from the triac Tr to the linear oscillating motor 10, and the voltage V3 supplied to the linear oscillating motor 10 through the capacitor C, estimates stroke information and current information, and transmits thusly estimated information to the stroke controller 33.

Thereafter, the stroke controller 33 controls in a manner that the stroke command value determined by the stroke command value determiner 31 to be identical to the estimated stroke value, and transmits the obtained timer command value to the timer 35.

Then, the zero-cross detector 34 receives the voltage V0 between the current sensing resistance R and the power supply voltage terminal, or the voltage V4, the one before passing the capacitor C starting from the power supply voltage terminal to detect a zero-cross point, and provides a detected zero-cross signal to the timer 35.

Then, the timer 35 receives the zero-cross signal to a start terminal thereof. When the zero-cross signal is inputted to the start terminal, the timer 35 sets a time t1 as shown in FIG. 2E according to a timer command value provided by the stroke controller 33.

After the time t1 is set, the timer 35 outputs a gate drive signal to the gate G of the triac Tr of the electric circuit unit 20. In this respect, if the time t1 is short as shown in FIG. 2C, the gate drive signal is set to be short from the time point of the zero-cross as shown in FIG. 2C, so that a large current flows as shown in FIG. 2D, while, if the time t1 is long as shown in FIG. 2E, the gate drive signal is distanced from the zero-cross time point, so that a small current flows as shown in FIG. 2F.

Therefore, as the gate drive signal is outputted to the gate G of the triac Tr of the electric circuit unit 20, the triac Tr is turned on and the current is supplied to the linear oscillating motor 10, and accordingly, the piston of the linear oscillating motor 10 moves upwardly and downwardly, thereby controlling the strength of cooling air of the refrigerator or the air-conditioner.

When the input current is applied as a periodic function, the movement of the piston has the same cycle, which has various shapes according to the pressure of suction and discharge.

FIG. 4 shows one example of it. Assuming that the cycle of the piston is 'T', since the stroke represents a maximum displacement within one cycle, it is defined by the following equation:

$S(k) \equiv \max(\bar{x}(t))$, $(k-\frac{1}{2})T \leqq t < (k+\frac{1}{2})T$ where $\bar{x}$ (t) is an estimated value by the senseless stroke estimator, there may exist an error between the estimated value and the real value as $e(k)=x(k)-\bar{x}(t)$.

In case that the linear oscillating motor 10 makes a model as an R-L circuit having a back electromotive force as shown in FIG. 3, a theoretical basis for representing the movement of the piston can be expressed by the following two non-linear simultaneous differential equation:

$$m\frac{d^2}{dt^2}+c\frac{dx}{dt}+kx=\alpha i-Fp(x) \tag{1}$$

$$L\frac{di}{dt}+(R+r)i+\frac{1}{C}\int i\,dt=V-\alpha\frac{dx}{dt} \tag{2}$$

where x indicates a displacement of the piston, i indicates a current flowing to the motor, m indicates a mass of the piston, C indicates a damping coefficient, k indicates an equivalent spring constant, Fp indicates a force applied by the piston, $\alpha$ indicates a back electromotive force constant, L indicates an equivalent inductance coefficient, R indicates an equivalent resistance, r indicates a resistance for sensing a strength of current ($r \ll R$), and V indicates an external voltage.

Referring to the above equation, Fp represents a force according to a pressure difference between suction and discharge, which is non-linearly varies momently while the compressor passes the suctioning-discharging-suctioning processes.

According to the equation, if the voltage V is increased, the right side of the equation (2) becomes larger, and thus, the current of the left side becomes strong. Then, the right side of the equation (1) becomes larger, and accordingly, the displacement of the piston of left side becomes larger.

That is, the stroke distance of the piston is varied by an applied voltage, and when the triac, a semiconductor switching device, is used, the applied voltage can be controlled by switching, having the same effect.

However, referring to the conventional linear compressor, when a stroke reaches the boundary (discharge valve face), as shown in FIG. 6, the operation of the piston often turns unstable. In other words, the operation of the piston becomes very unstable at the position where the piston very nears the discharge valve and almost collides with the discharge valve.

In addition, referring to the linear compressor, its efficiency is the best at tuning point and noise is the least generated. In this respect, it often occurs that the operation of the piston becomes unstable as shown in FIG. 6. The reason for this has not been revealed. One of assumption is that it may be due to a hysteresis characteristics of an actuator, which is shown in a simulation based on an experiment and the above equations (1) and (2).

The instability of the operation of the piston leads to a problem in that the input power supply is shaken, and the strength of cooling air is accordingly shaken, which is very undesirable for the refrigerator or the air-conditioner adapting the liner compressor. In this respect, however, notably, an optimum operational point can be detected by using the fact that the unstable phenomenon occurs in the tuning point.

In addition, in the conventional linear compressor, a clearance volume needs to be controlled accurately, but due to the characteristics deviation of parts of the complicated sensorless circuit or the deviation between the major mechanic parts inside the compressor, a serious deviation is made even from a desired strength of cooling air under the same stroke control.

SUMMARY OF THE INVENTION

Therefore, an object of the present invention is to provide an apparatus for controlling a linear compressor which is suitable to an abnormality detection and intelligence control by preventing an unstable phenomenon and correcting a reference stroke by itself if any unstable phenomenon occurs, and to its controlling method.

Another object of the present invention is to provide an apparatus and method for controlling a linear compressor in which an operation of the linear compressor is controlled by having two intervals, of which one is where a tuning instability region exists and the other is where the tuning instability region does not exist, depending on the discharge side pressure and the suction side pressure of the linear compressor.

Still another object of the present invention is to provide, an apparatus and a method for controlling a linear compressor of which a tuning instability region is searched for in the interval where the tuning instability region exists so as to be evaded, thereby obtaining an optimal operation.

Yet another object of the present invention is to provide an apparatus for automatically correcting a deviation of a linear compressor which is capable of automatically correcting parts deviation of a sensorless circuit or a deviation of major parts inside the compressor to optimally adjust a mechanic unit and a control unit by itself, thereby obtaining an even cooling capacity.

To achieve these and other advantages and in accordance with the purposed of the present invention, as embodied and broadly described herein, there is provided an apparatus for controlling a linear compressor having an electric circuit unit for supplying a current to a linear oscillating motor and a control unit for outputting a gate drive signal to render a stroke command value according to temperature information to be identical to a stroke estimated by a stroke voltage applied to the linear oscillating motor, wherein the control unit includes a cooling mode determiner for determining a cooling mode according to inputted temperature information; a sensorless stroke estimator for receiving stroke voltages supplied to the linear oscillating motor, estimating a stroke value and current information, and outputting the estimated stroke value and the current information; an instability monitoring unit for monitoring whether an instability occurs by using the stroke value and the current information outputted from the sensorless stroke estimator, and outputting monitored information; a stroke command value determiner for determining an adequate stroke command value in consideration of an overall situation from the cooling mode determined by the cooling mode determiner and from the information on the occurrence of the instability as outputted by the instability monitoring unit; a stroke controller for adjusting the stroke estimated by the sensorless stroke estimator to fit the stroke command value determined by the stroke command value determiner, and accordingly outputting a timer command value; a zero-cross detector for detecting a zero-cross point from an inputted voltage waveform and outputting a zero-cross signal; and a timer for providing a gate drive signal according to the value estimated by the stroke controller to the time point when the zero-cross signal is outputted from the zero-cross detector.

There is also provided a method for controlling a linear compressor including the steps of: setting a stroke command value corresponding to a cooling mode command value in a step S1; checking whether or not a timer is driven in a step S2; checking a current state of instability of the stroke if the timer is not driven in the step S2 in a step S3; operating the linear compressor for a predetermined time by lowering down the set stroke command value as much as a predetermined value if the stroke is in an unstable state, while operating the linear compressor according to the stroke command value as set in the step S1 in a step S4, if the stroke is in a stable state; and returning the currently driven stroke command value to an original stroke command value when a corresponding time lapses after the timer is driven in the step S2.

Also, there is provided a method for controlling a linear compressor including the steps of: setting a stroke command value corresponding to a cooling mode command value in a step S1; checking whether the stroke is in an unstable state or in a stable state in a step S2; lowering down the stroke command value as much as a predetermined value to operate the linear compressor for a predetermined time if the stroke is in an unstable state in a step S3; checking whether or not the time is driven, if the stroke is in a stable state, in the step S2 in a step S4; and outputting the stroke command value as set in the step S1 if the timer was not driven, while returning the currently driven stroke command value to an original stroke command value when a corresponding time lapses after the timer is driven, in a step S5.

There is also provided an apparatus for automatically correcting a deviation of a linear compressor having an electric circuit unit for controlling an alternate current power source according to a gate driver signal to vary a stroke, thereby controlling the power applied to a linear oscillating motor that controls the strength of cooling air, and a control unit for outputting a gate drive signal to render a stroke command value according to temperature information to be identical to a stroke estimated by a stroke voltage applied to the linear oscillating motor, wherein the control unit includes a sensorless stroke estimator for receiving stroke voltages supplied to the linear oscillating motor, estimating a stroke value and current information to output them; an instability monitoring unit for monitoring whether the current stroke is in an unstable state or in a stable state upon receipt of the information from the sensorless stroke estimator; a tuning point determiner for determining a tuning point from the stroke value estimated by the sensorless stroke estimator and outputting it, if it receives information about instability from the instability monitoring unit; a stroke command value determiner for determining a stroke command value by using temperature information from an external source and the tuning point determined by the tuning point determiner; a stroke controller for adjusting the stroke estimated by the sensorless stroke estimator to fit the stroke command value determined by the stroke command value determiner, and accordingly outputting a timer command value; a zero-cross detector for detecting a zero-cross point from an inputted voltage waveform and outputting a zero-cross signal; and a timer for providing a gate drive signal according to the value estimated by the stroke controller to the time point when the zero-cross signal is outputted from the zero-cross detector.

The stroke command value determiner of the apparatus for automatically correcting a deviation of a linear compressor includes: a cooling mode determiner for judging whether it is an actuating state or a cooling state according to inputted temperature information and determining whether a tuning mode is to be selected or a cooling mode is to be selected; a first switch for switching to a corresponding mode according to an output from the cooling mode determiner; a tuning mode controller for outputting a stroke command value for tuning in case that the actuating mode is judged by the cooling mode determiner; a cooling mode control unit for correcting a stroke command value according to the first, the second, . . . the nth cooling mode by using a relative coordinate value and outputting the corrected stroke command value, in case that the cooling mode is judged by the cooling mode determiner and the current stroke is in an unstable state: and a second switch for providing the stroke command values respectively outputted from the tuning mode controller and the cooling mode control unit to the stroke controller.

The tuning point determiner of the apparatus for automatically correcting a deviation of the linear compressor determines a tuning point by scanning the stroke estimated by the sensorless stroke estimator while increasing it step by step.

The tuning point determiner of the apparatus for automatically correcting a deviation of the linear compressor determines the tuning point by scanning the stroke estimated by the sensorless stroke estimator by using a slow RAMP function.

There is also provided a method for controlling an operation of a linear compressor including the steps of: setting both intervals where a tuning instability region exists and where a tuning instability region does not exist depending on a discharge side pressure and a suction side pressure of the compressor or an outer air temperature; controlling an oscillating motor with a lowly or a highly predetermined stroke voltage at the interval where a tuning instability region does not exist, while detecting a tuning instability region and maintaining a stroke voltage at the very upper portion of the tuning instability region at the interval where a tuning instability region exists for operation of the linear compressor.

In the method for controlling the operation of the linear compressor, the intervals where the discharge side pressure Pd and the suction side pressure Ps of the compressor are all below a predetermined pressure and where the discharge side pressure Pd and the suction side pressure Ps of the compressor are all beyond a predetermined pressure are set as intervals where the tuning instability region does not exist, while the interval placed between the two intervals is set as an interval where the tuning instability region exists.

In the method for controlling the operation of the linear compressor, both the temperature level where an outer air temperature of the compressor is low below a predetermined temperature and the temperature level where the outer air temperature of the compressor is high beyond a predetermined temperature are set as intervals where the tuning instability region does not exist, while a temperature level between the above two temperature levels is set as an interval where the tuning instability region exists.

In the method for controlling the operation of the linear compressor, the oscillating motor is controlled at a high or low constant stroke voltage at the interval where the tuning instability region does not exist, while it is controlled by varying the stroke voltage after detecting an optimal point at the interval where the tuning instability region exists.

In the method for controlling the operation of the linear compressor, at the interval where the tuning instability region exists, the tuning instability region is searched for by increasing the stroke voltage value from the lowest point of the stroke by predetermined voltage values, and when the tuning instability region is detected, a predetermined voltage value is again increased so as to constantly maintain the stroke voltage at the very upper portion of the tuning instability region, and then, after a predetermined time lapses, the tuning instability region is again search for by reducing the stroke voltage value by predetermined values, and when the tuning instability region is detected, the stroke voltage value is again increased, according to which the optimal operating point to be placed at the very upper portion of the tuning instability region.

In the method for controlling the operation of the linear compressor, the oscillating motor is simply accelerated until the stroke voltage value reaches the lower limit value from a zero value, to thereby reduce a searching time.

In the method for controlling the operation of the linear compressor, in case that an abnormal state occurs while the oscillating motor is being controlled at a constant stroke voltage or a varying stroke voltage, the stroke is controlled to be short, and then, when the normal state is restored, it returns to the previous stroke.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings:

FIGS. 2A–2F illustrate waveforms of each part of FIG. 1 in accordance with the conventional art;

FIG. 3 is an equivalent circuit diagram in case where a linear oscillating motor is made to a model as a R-L circuit having a back electromotive force of FIG. 1 in accordance with the conventional art;

FIG. 19 illustrates an absolute coordinate value and a relative coordinate value according to a cooling mode in accordance with the present invention;

FIGS. 20A and 20B illustrate existence and nonexistence of a tuning instability region in the linear compressor depending on a suction side pressure and discharge side pressure of the linear compressor and an outer air temperature in accordance with the present invention;

DETAILED DESCRIPTION OF THE PREFERRED EMBODIMENTS

Reference will now be made in detail to the preferred embodiments of the present invention, examples of which are illustrated in the accompanying drawings.

Figure 1:
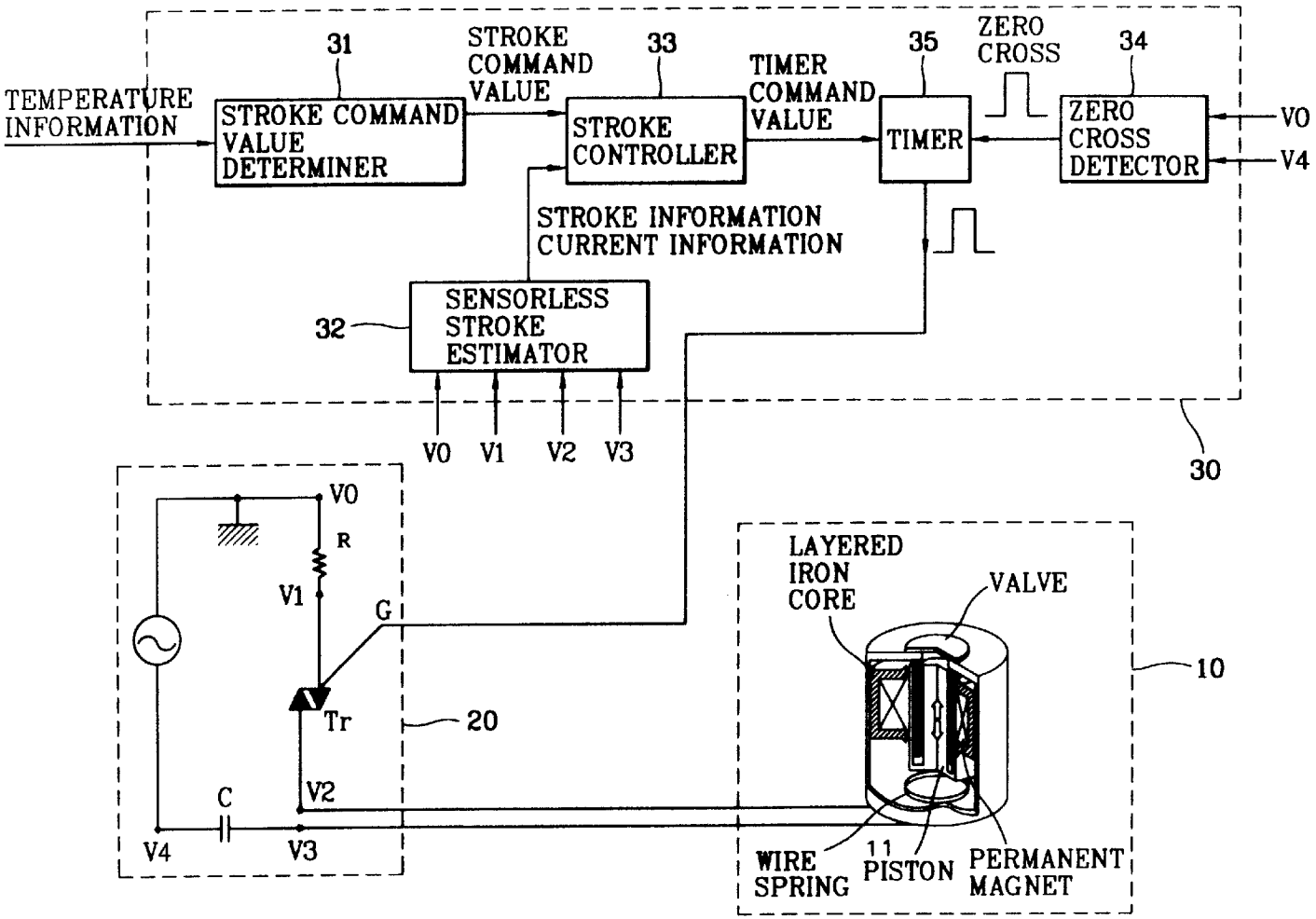
FIG. 1 CONVENTIONAL ART
FIG. 1 is a schematic block diagram of an apparatus for controlling a linear compressor in accordance with a conventional art.
Figure 4:
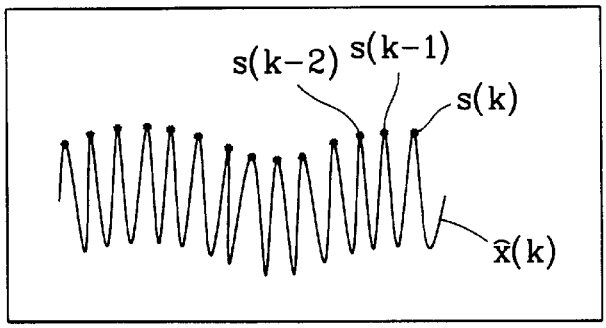
FIG. 4 CONVENTIONAL ART
FIG. 4 illustrates a waveform of a cycle of movement of a piston according a suction side pressure and discharge side pressure of FIG. 1 in accordance with the conventional art.
Figure 5:
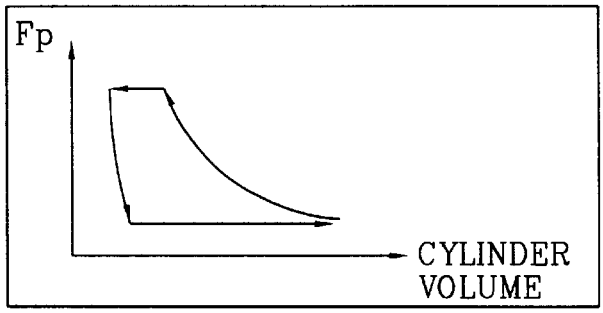
FIG. 5 CONVENTIONAL ART
FIG. 5 illustrates a waveform for a force (Fp) applied to the piston which is non-linearly varied while passing the processes of suctioning-compressing-discharging of FIG. 1 in accordance with the conventional art.
Figure 6:
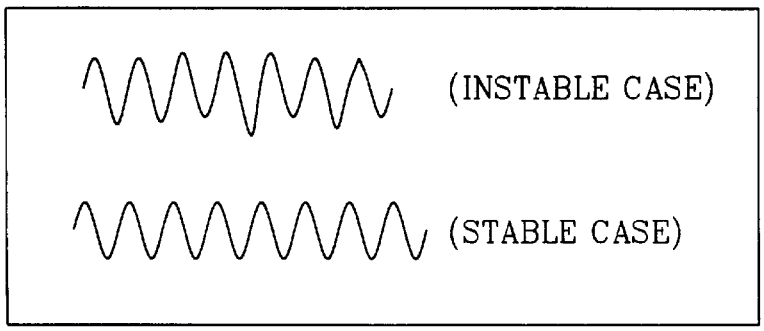
FIG. 6 CONVENTIONAL ART
FIG. 6 illustrates waveforms of unstable case and stable case for the cycle of the movement of the piston according to the suction side pressure and the discharge side pressure of FIG. 1 in accordance with the conventional art.
Figure 7:
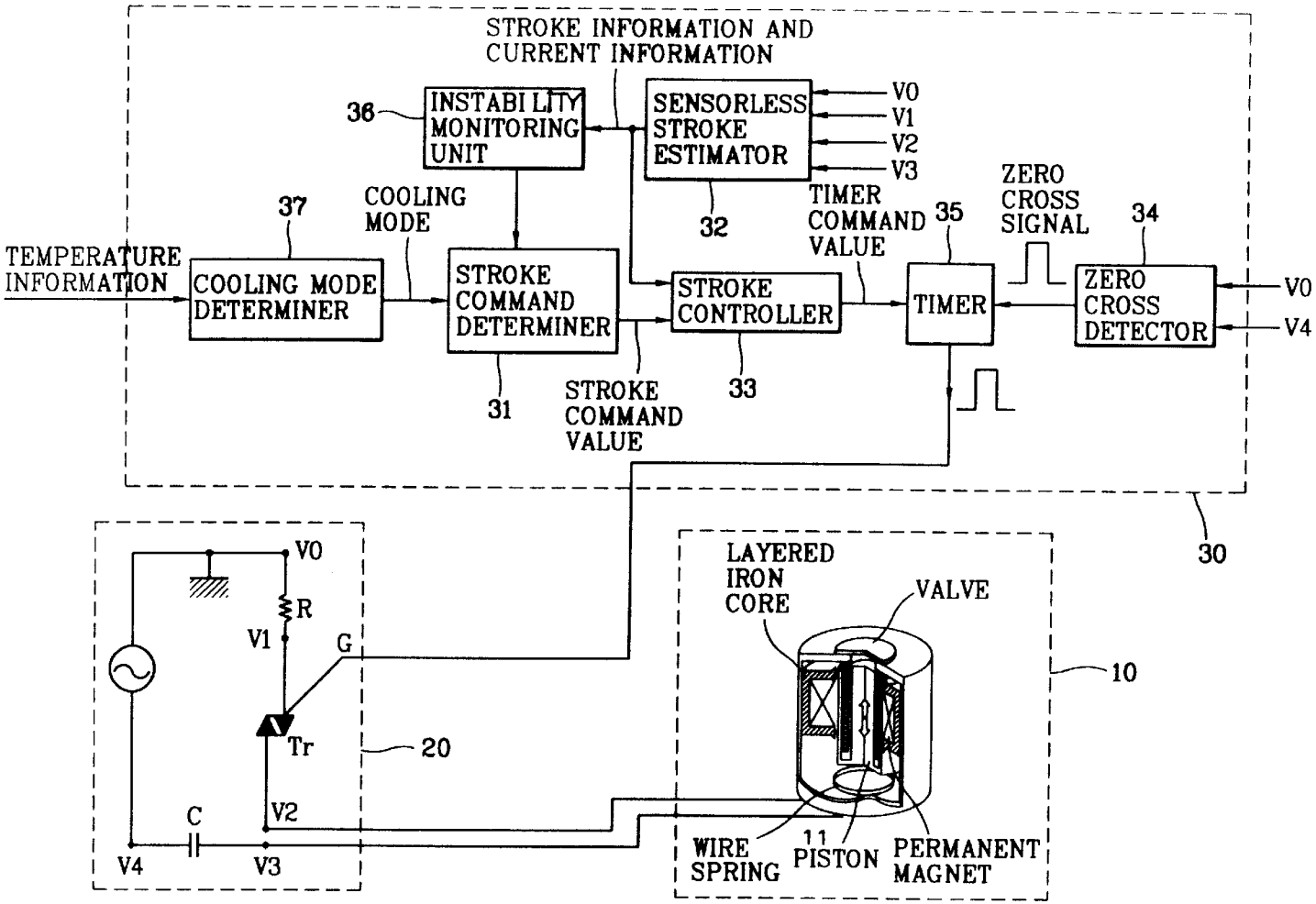
FIG. 7 is a schematic block diagram of an apparatus for controlling a linear compressor in accordance with the present invention.

FIG. 7 is a schematic block diagram of an apparatus for controlling a linear compressor in accordance with the present invention.

As shown in the drawing, an apparatus for controlling a linear compressor having an electric circuit unit for supplying a current to a linear oscillating motor and a control unit for outputting a gate drive signal to render a stroke command value according to temperature information to be identical to a stroke estimated by a stroke voltage applied to the linear oscillating motor, wherein the control unit includes a cooling mode determiner for determining a cooling mode according to inputted temperature information; a sensorless stroke estimator for receiving stroke voltages supplied to the linear oscillating motor, estimating a stroke value and current information, and outputting the estimated stroke value and the current information; an instability monitoring unit for monitoring whether an instability occurs by using the stroke value and the current information outputted from the sensorless stroke estimator, and outputting monitored information; a stroke command value determiner for determining an adequate stroke command value in consideration of an overall situation from the cooling mode determined by the cooling mode determiner and from the information on the occurrence of the instability as outputted by the instability monitoring unit; a stroke controller for adjusting the stroke estimated by the sensorless stroke estimator to fit well the stroke command value determined by the stroke command value determiner, and accordingly outputting a timer command value; a zero-cross detector for detecting a zero-cross point from an inputted voltage waveform and outputting a zero-cross signal; and a timer for providing a gate drive signal according to the value estimated by the stroke controller to the time point when the zero-cross signal is outputted from the zero-cross detector.

An operation of the apparatus for controlling a linear compressor constructed as described above will now be explained.

A power supply voltage from the power supply voltage terminal is supplied to the linear oscillating motor 10 through the current sensing resistance R, the triac Tr and the capacitor C of the electric circuit unit 20, according to which the current flows to the linear oscillating motor 10. Then, the piston 11 of the linear oscillating motor 10 performs a reciprocal movement, and the strength of cooling air of the refrigerator and the air-conditioner is adjusted by varying the stroke.

At this time, when a temperature of the refrigerator or the air-conditioner is set by a user, the set temperature information is received by the cooling mode determiner 37 of the control unit 30. Then, the cooling mode determiner 37 determines a cooling mode corresponding to the received temperature and provides the determined cooling mode to the stroke command value determiner 31.

At this time, the sensorless stroke estimator 32 receives from the linear oscillating motor 10 the stroke voltages (V0–V4), that is, the voltage V0 between the current sensing resistance R and the power supply voltage terminal, the voltage V1 between the current sensing resistance R and the triac Tr, the voltage V2 supplied from the triac Tr to the linear oscillating motor 10, the voltage V4, the one before passing the capacitor C from the power supply voltage terminal, and the voltage V3 supplied to the linear oscillating motor 10 through the capacitor C, estimates stroke information and current information, and transmits thusly estimated information to the instability monitoring unit 36.

Then, the instability monitoring unit 36 recognizes whether the stroke is in an unstable state or in a stable state by using the stroke information estimated by the stroke estimating unit 32.

Figure 9:
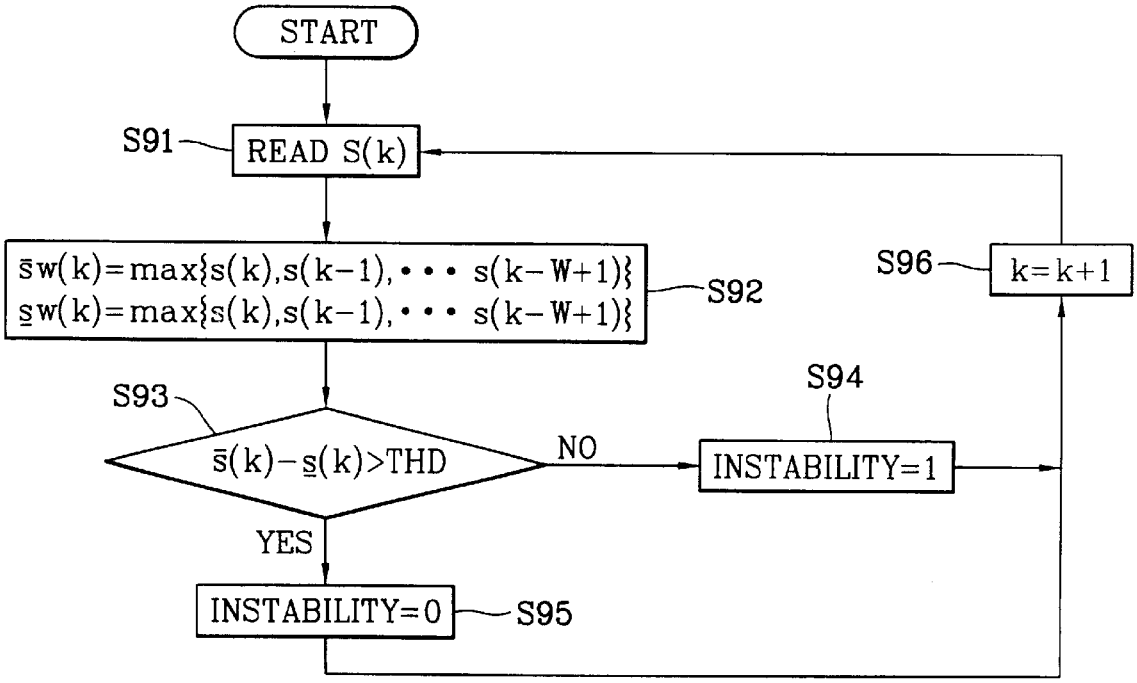
FIG. 9 is a flow chart of the process of monitoring by the instability monitoring unit of FIG. 7 in accordance with the present invention.

Details for the operation will now be described with reference to FIG. 9.

Figure 8:
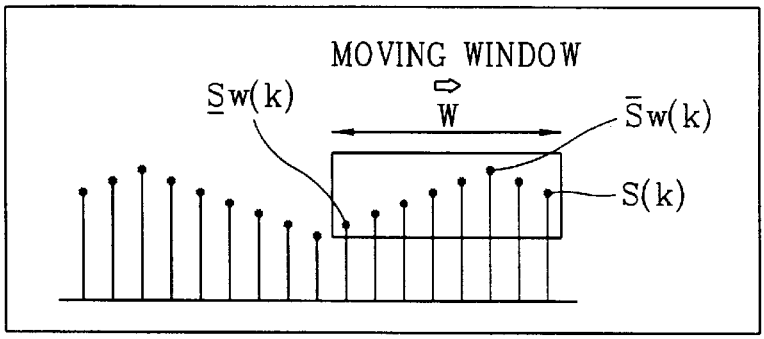
FIG. 8 illustrates a waveform of a cycle of movement of a piston in an instability monitoring unit of FIG. 7 in accordance with the present invention.

First, the instability monitoring unit 36 reads a stroke (s(k)) out of the stroke information provided by the sensorless stroke estimator 32 in a step S91. That is, it reads a predetermined width (W) of stroke (s(k)) as shown in FIG. 8. And then, a maximum value ($\overline{S}$w(k)) and a minimum value ($\underline{S}$w(k)) are obtained from the stroke as read in a step S92.

$$\overline{S}w(k)=\max\{s(k),s(k-1), \ldots , s(k-w+1))$$

$$\underline{S}w(k)=\min\{s(k),s(k-1), \ldots , s(k-w+1))$$

Thereafter, a difference ($\overline{S}$w(k)–$\underline{S}$w(k)) between the maximum value and the minimum value of the stroke is calculated, and the calculated difference is compared to a pre-set reference value THD in a step S93.

Upon such comparison, if the difference is larger than the reference value THD, the instability monitoring unit 36 recognizes it as an unstable state in a step S94, while if the difference is smaller than the reference value, the instability monitoring unit 36 recognizes it as a stable state in a step S95. After recognizing the unstable state and stable state in the steps S94 and S95, the instability monitoring unit 36 reads the next stroke.

In this manner, the instability monitoring unit 36 judges whether the stroke is in an unstable state or in a stable state, and transfers the judged information to the stroke command value determiner 31.

Then, the stroke command value determiner 31 determines the most adequate stroke command value on the basis of the cooling mode determined by the cooling mode determiner 37 and the information monitored by the instability monitoring unit 36 and transfers it to the stroke controller 33.

Figure 10:
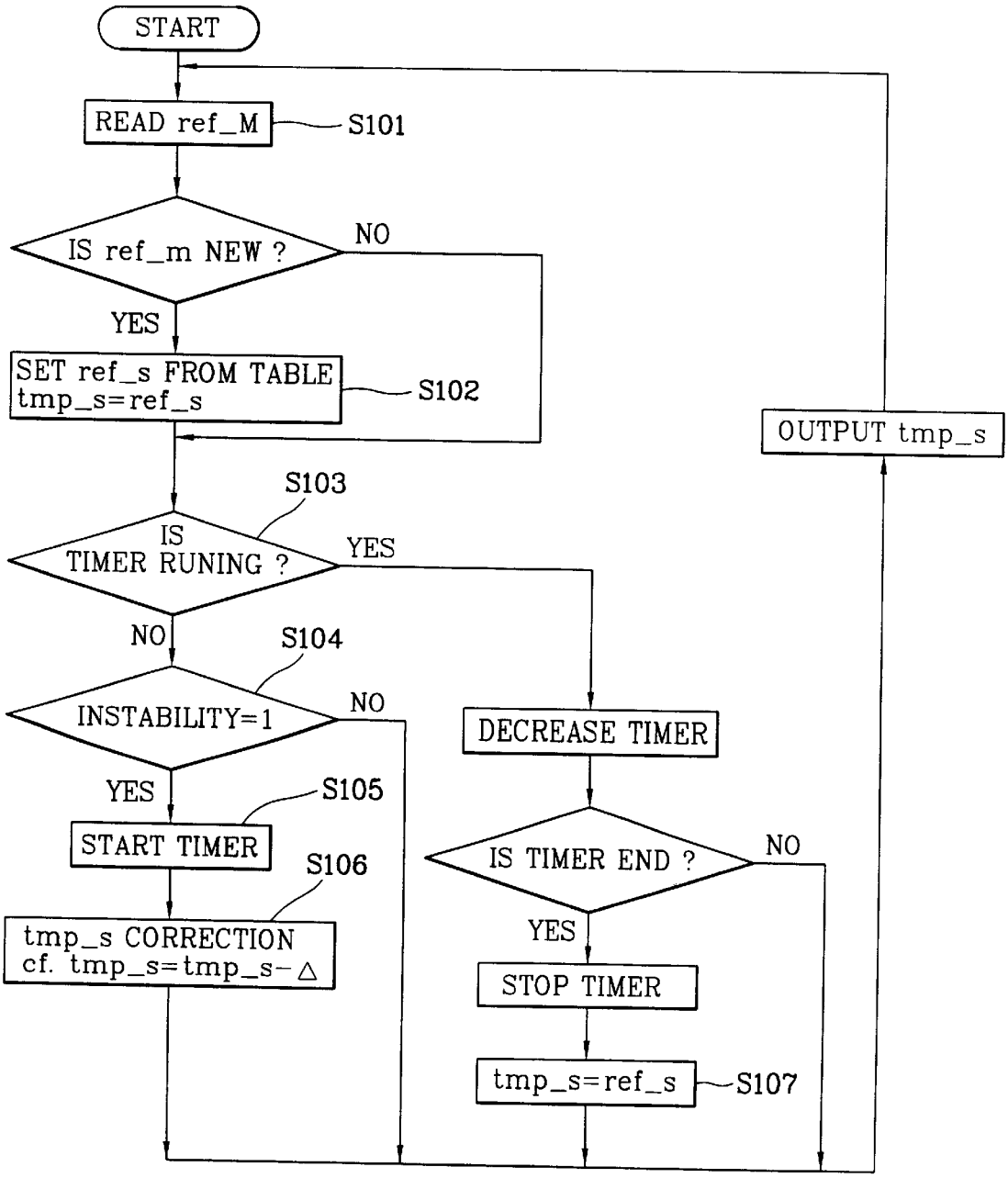
FIG. 10 is a flow chart of a process for determining a stroke command value by a stroke command value determiner of Figure in accordance with one embodiment of the present invention.

The process for determining the stroke command value will now be described with reference t o FIG. 10.

The stroke command value determiner 31 reads a command value ref_M of the cooling mode determined by the cooling mode determiner 37 In a step S101. For instance, if the cooling modes are M1, M2 and M3, the stroke reference values determined to be corresponded to each mode would include three of s1, s2 and S3.

A stroke command value ref_s corresponding to the cooling mode command value ref_M as read In the step S101 is set from reading it from a memory tmp_s in a step S102. After the stroke command value for the cooling mode is thusly set, it is checked whether the timer is driven or not in a step S103.

The timer serves to count time for evading an unstable state for a predetermined time for the stroke in case that the stroke is in the unstable state. If the timer is not driven in the step S103, it is checked whether or not the current stroke is in an unstable state in a step S104.

Upon checking, if the stroke is currently in the unstable state, the timer is driven to evade it for a predetermined time in a step S105, and transfers the stroke command value ref_s corresponding to the cooling mode command value ref_M to a lower stroke command value in a step S106.

For example, the state set as a stroke command value ref_s2 corresponding to the cooling mode command value ref_M2 is an unstable state, it is changed to ref_s2-Δ. And, if the timer is driven in the step S103, the time is counted, and when a corresponding time lapses, it returns to the original stroke command value ref_s in a step S107.

As described above, the stroke command value determiner 31 sets the stroke command value according to the cooling mode command value for operation, and then when an instability occurs, the stroke command value determiner 31 changes the stroke command value by lowering it down. While the stroke command value determiner 31 is operated by the changed stroke command value for a predetermined time, when the predetermined time lapses, the stroke command value determiner 31 returns it to the original stroke command value.

Figure 11:
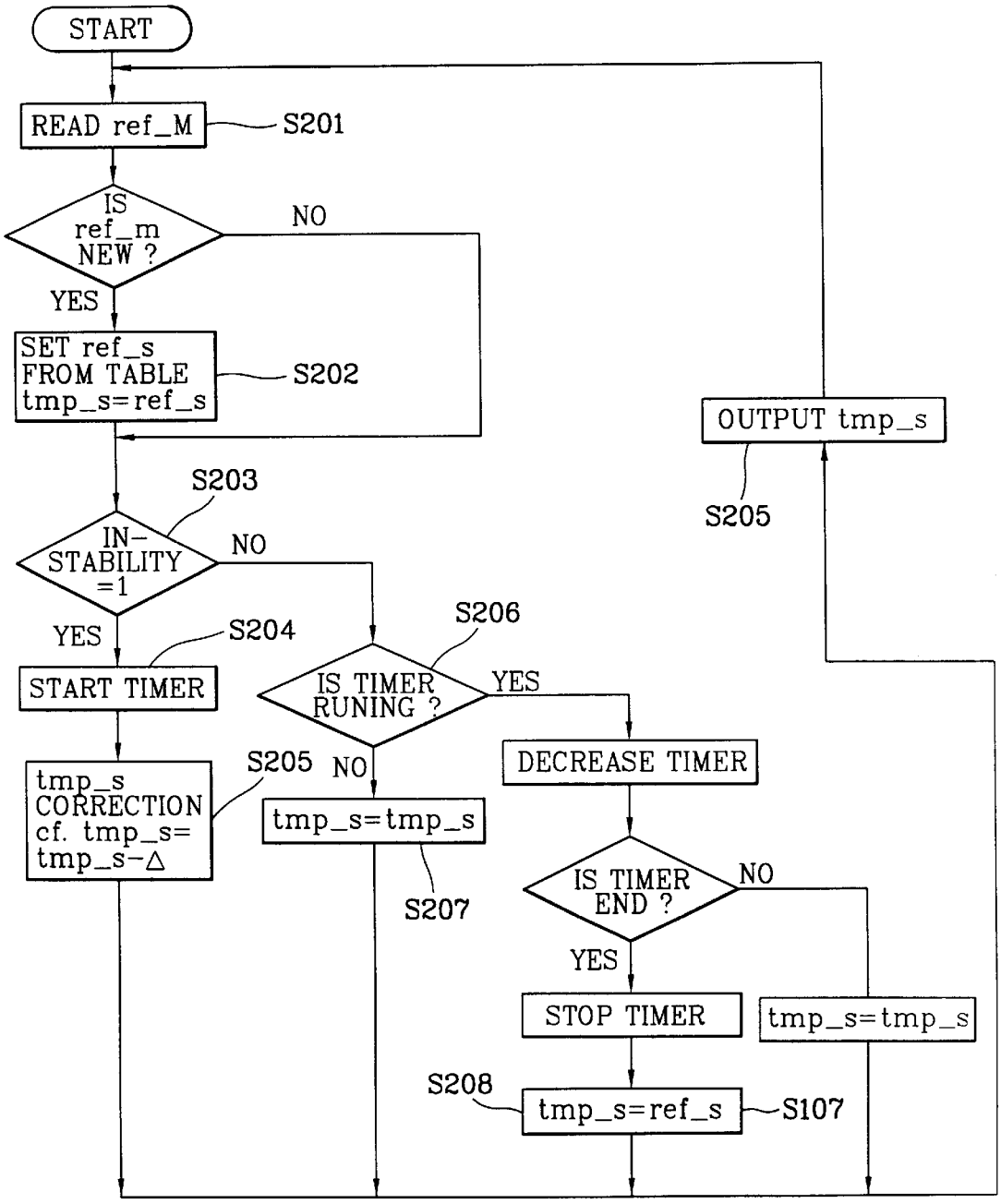
FIG. 11 is a flow chart of a process for determining a stroke command value by a stroke command value determiner of FIG. 7 in accordance with another embodiment of the present invention.

FIG. 11 is a flow chart of a process for determining a stroke command value by a stroke command value determiner of Figure in accordance with another embodiment of the present invention. As shown in this drawing, the stroke command value determiner 31 reads a cooling mode command value ref_M determined by the cooling mode determiner 37 in a step S201. And, it reads a stroke command value ref_s corresponding to the cooling mode command value ref_M as read in the step S201 from a memory tmp_s and sets it in a step S202. Thereafter, it checks whether the current stroke is in a stable state or in an unstable state in a step S203.

If the stroke is in an unstable state, the stroke command value determiner 31 drives the timer for evading it for a predetermined time in a step S204, changes the set stroke command value ref_s to a command value lowered as much as a predetermined value Δ, and outputs the changed stroke command value in a step S205. On the other hand, if the stroke is in a stable state in the step S203, the stroke command value determiner checks whether the timer is driven in a step S206.

Upon checking, if the timer is not driven, the stroke command value determiner uses the stroke command value stored in the memory tmp_s as it is in a step S207, while if the timer is driven, it waits for a predetermined time and ends it. And then, the stroke command value determiner returns it to the original stroke command value ref_s, and outputs the returned stroke command value in a step S208.

When the stroke command value obtained by performing the above operation is provided to the stroke controller 33, the stroke controller 33 adjusts the stroke command value and the command value estimated by the sensorless stroke estimator 32 to be identical to each other, and outputs a timer command value to the timer 35.

At this time, the zero-cross detector 34 reads the voltage V0 or V4 from the electric circuit unit 20, detects a zero-cross point and provides it to the start terminal of the timer 35.

Upon receipt of the zero-cross point, the timer 35 outputs a gate drive signal to the gate terminal G of the triac Tr of the electric circuit unit 20 by using the stroke command value provided from the stroke command value determiner 31, taking the time point of the zero-cross point inputted to the start terminal as a time point.

Then, the triac Tr is turned on and the current is supplied to the linear oscillating motor 10, according to which the piston of the linear oscillating motor 10 moves upward and downward, thereby adjusting the strength of the cooling air of the refrigerator or the air-conditioner.

Figure 12:
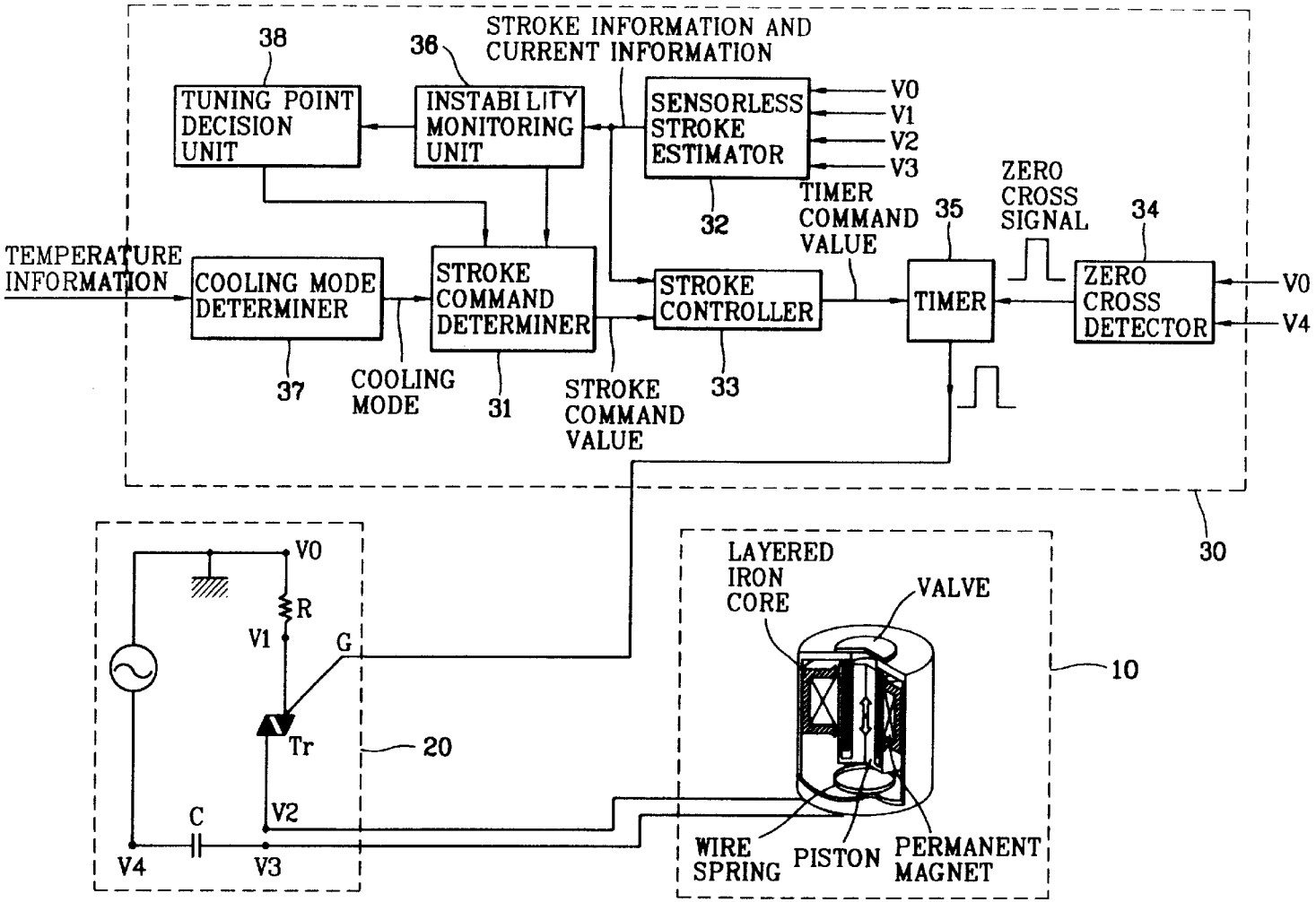
FIG. 12 is a schematic block diagram of an apparatus for automatically correcting deflection of a linear compressor in accordance with the present invention.

FIG. 12 is a schematic block diagram of an apparatus for automatically correcting deflection of a linear compressor in accordance with the present invention.

As a factor causing a deviation in the strength of the cooling air includes a control factor and a mechanic factor.

First, the control factor is due to a circuit. For example, in case that the sensorless stroke estimator 32 of the control unit 30 of FIG. 7 is constructed as an analog circuit as shown in FIG. 15, the characteristic deviation of the capacitor such as Cs, C1 or C2 causes a recognition tolerance of the stroke.

Figure 15:
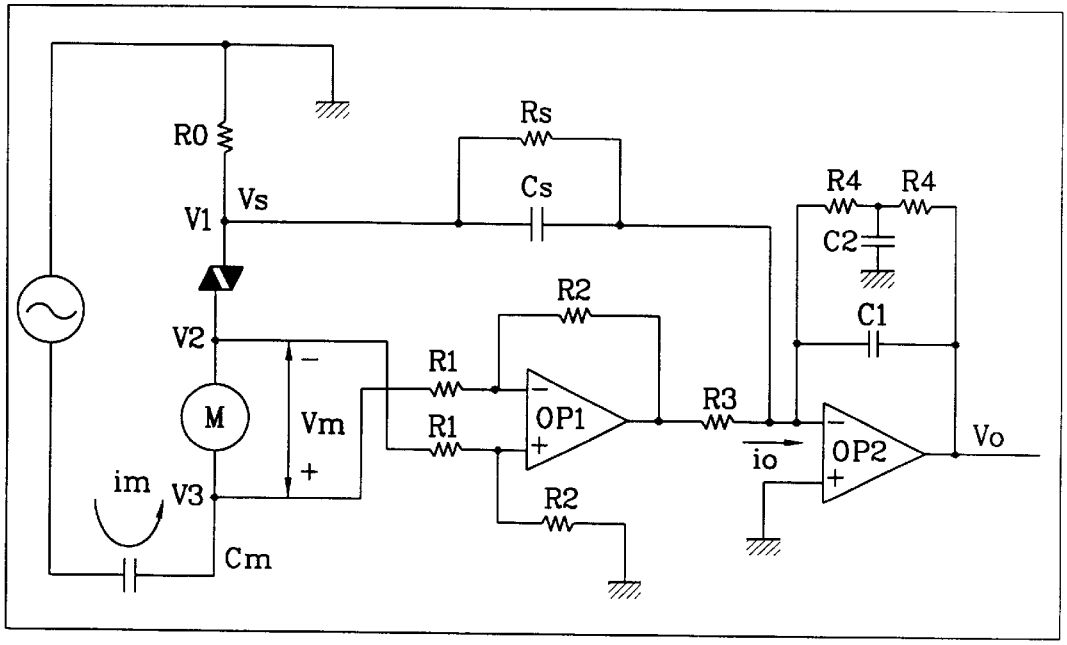
FIG. 15 is an analog circuit diagram for a sensorless stroke estimator of FIG. 7 in accordance with the present invention.
Figure 16:
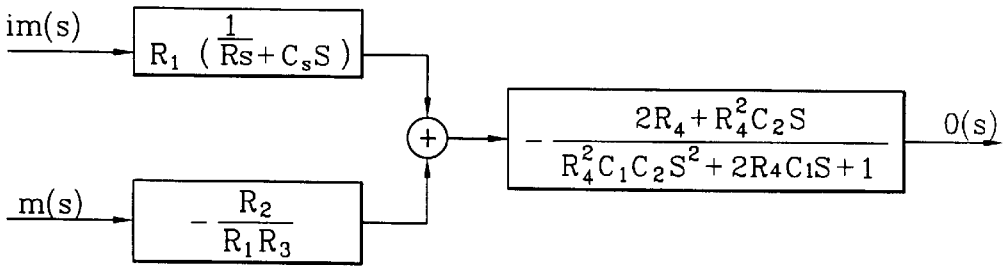
FIG. 16 is a block diagram of the analog circuit diagram of FIG. 15 in accordance with the present invention.

In FIG. 16, which is a block diagram of the analog circuit diagram of FIG. 15, it is noted that the capacitor value has a close relationship with the transfer function.

In detail, assuming that the transfer functions between a current stroke and a voltage stroke without parts deviation is respectively G1 and G2, the transfer function when the input is defined as a vector of [current, voltage] would be G=[G1, G2]. Accordingly, the deviations of the capacitor ΔGs, ΔD1 and C2 cause a deviation of the transfer function ΔG=[ΔC1, ΔC2], leading to a recognition tolerance of the stroke.

And, in case that ΔG>0, it is recognized as a value larger than the actual stroke value. Meanwhile, when the stroke is controlled by a closed-loop control in order to adjust suitably the stroke to the command value, the stroke becomes smaller than the true value. With the same logic, in case that ΔG<0, the stroke becomes larger than the true value due to the feedback control. This kinds of deviation need to be reduced.

Figure 14:
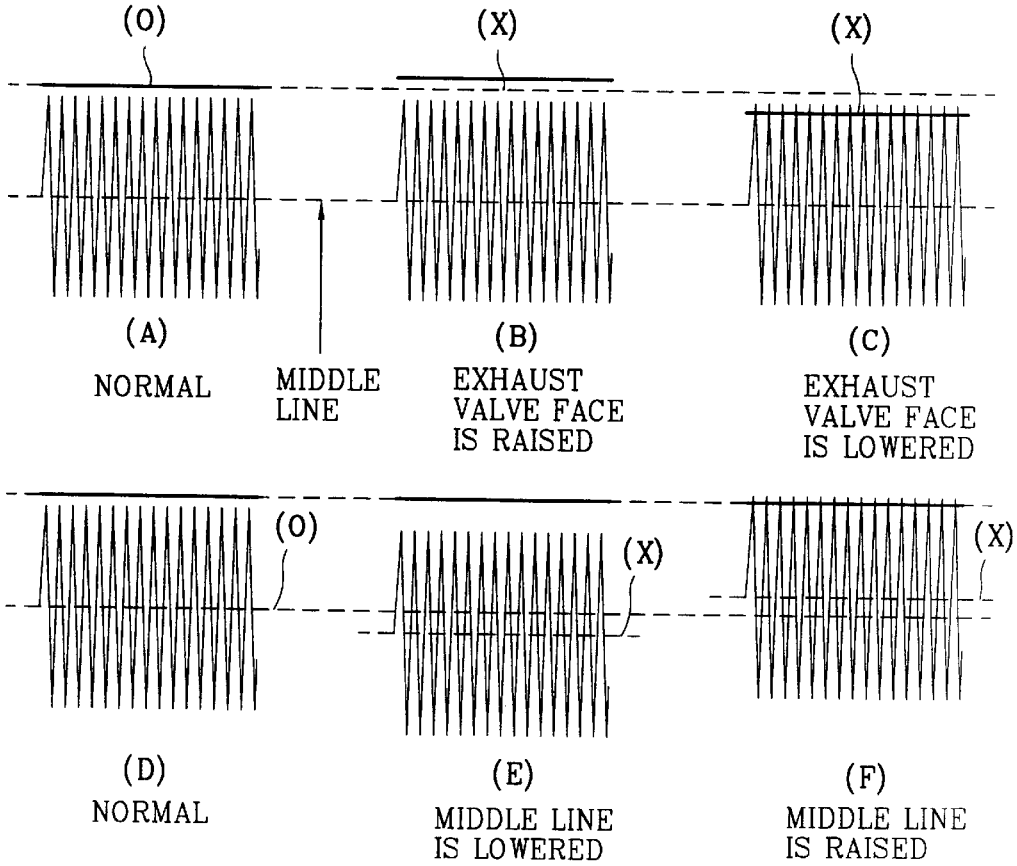
FIG. 14 illustrates cycle of waveforms of stroke deviation according to changes of the middle line of the piston's movement and a movement of a discharge valve plane in the linear oscillating motor of FIG. 7 in accordance with the present invention.

In addition, a deviation of the strength of cooling air owing to the mechanic deviation is very critical. The deviation of the strength of cooling air is caused when the linear oscillating motor 10 is controlled, which will now be described with reference to FIG. 14 illustrating cycle of waveforms of stroke deviation according to changes of the middle of the piston's movement and a movement of a discharge valve plane in the linear oscillating motor of FIG. 7 in accordance with the present invention.

In the drawing, (A) illustrates that the discharge valve face is in a normal state, (B) illustrates that the discharge valve face is raised up, and (C) illustrates that the discharge valve face is lowered down.

In this respect, in case that the distance from the piston to the discharge valve face is changed, the compression ratio is changed under the same stroke, and thus, the strength of the cooling air is accordingly changed. Factors causing such a distance deviation from the piston to the discharge valve face are a process tolerance and an assembly tolerance. Referring to FIG. 14, (D) illustrates that the middle line of the movement of the piston is in a normal position, (E) illustrates that the middle line of the movement of the piston is lowered down, and (F) illustrates that the middle line of the movement of the piston is raised up.

A position deviation of a permanent magnet depending on the tolerance in the mechanic spring causes the deviation of the middle line of the movement of the piston, according to which a compression ratio is changed under the same stroke and the strength of the cooling air is changed.

Therefore, in order to have a good matching between the mechanic unit and the control unit, (B) and (E) need a larger stroke command value, for which a desirable condition is ΔG<0, while in case of (C) and (F), they need a smaller stroke command value, for which desirable condition is ΔG>0.

If a control unit including a sensorless stroke estimator 32 having a condition that ΔG>0 is combined with a mechanic unit having the deviation as shown in either case of (B) and (C), and the tolerance between them is great, a strength of cooling air may be hardly obtained for the refrigerator or the air-conditioner.

Meanwhile, in the sensorless stroke estimator 32, in case that the control unit having a condition that ΔG<0 is combined with the mechanic unit having a deviation of (C) and (F) as shown in FIG. 14, if the difference is very big, an excessive current flows or the piston would be severely bumped to the valve, resulting in that the durability of the compressor of the refrigerator or the air-conditioner would be shortened.

Accordingly, when there occur such deviations, preferably, a self-tuning or a self-matching is desired for correcting such deviation by itself.

Details of the self-tuning and the self-matching are as follows.

When a 220V of power supply voltage is supplied from the power supply voltage terminal, the power supply voltage is supplied to the linear oscillating motor 10 through the current sensing resistance R, the triac Tr and the capacitor C of the electric circuit unit 20, according to which the current flows to the linear oscillating motor 10. Then, the piston 11 of the linear oscillating motor 10 performs a reciprocal movement, and the strength of cooling air of the refrigerator and the air-conditioner is adjusted by varying the stroke.

At this time, the sensorless stroke estimator 32 reads the voltages V0–V3 supplied to the linear oscillating motor 10 from the electric circuit unit 20. On the basis of the voltages as read, the sensorless stroke estimator 32 estimates a stroke value and the current information, and transfers the estimated stroke information and the current information to the instability monitoring unit 36, the tuning point determiner 37, and the stroke controller 33, respectively.

Then, by using the stroke information estimated by the sensorless stroke estimator 32, the instability monitoring unit 36 checks the current state of the stroke as to whether it is in an unstable state or in a stable state, details of which will now be described.

First, the instability monitoring unit 36 reads a stroke (s(k)) out of the stroke information provided by the sensorless stroke estimator 32 in a step S91. That is, it reads a predetermined width (W) of stroke (s(k)) as shown in FIG. 8. And then, a maximum value ($\overline{S}$w(k)) and a minimum value ($\underline{S}$w(k)) are obtained from the stroke as read in a step S92.

$$\overline{S}w(k)=\max\{s(k),s(k-1), \ldots , s(k-w+1)$$

$$\underline{S}w(k)=\min\{s(k),s(k-1), \ldots , s(k-w+1)$$

Thereafter, a difference ($\overline{S}$w(k)−$\underline{S}$w(k)) between the maximum value and the minimum value of the stroke is calculated, and the calculated difference is compared to a pre-set reference value THD in a step S93.

Upon such comparison, if the difference is larger than the reference value THD, the instability monitoring unit 36 recognizes it as an unstable state in a step S95, while if the difference is smaller than the reference value, the instability monitoring unit 36 recognizes it as a stable state in a step S94. After recognizing the unstable state and stable state in the steps S94 and S95, the instability monitoring unit 36 sets the next predetermined region in a step S96, and returns to the step S91 for repeating.

In this manner, the instability monitoring unit 36 judges whether the stroke is in an unstable state or in a stable state, and transfers the judged information to the tuning point determiner 37.

Figure 17:
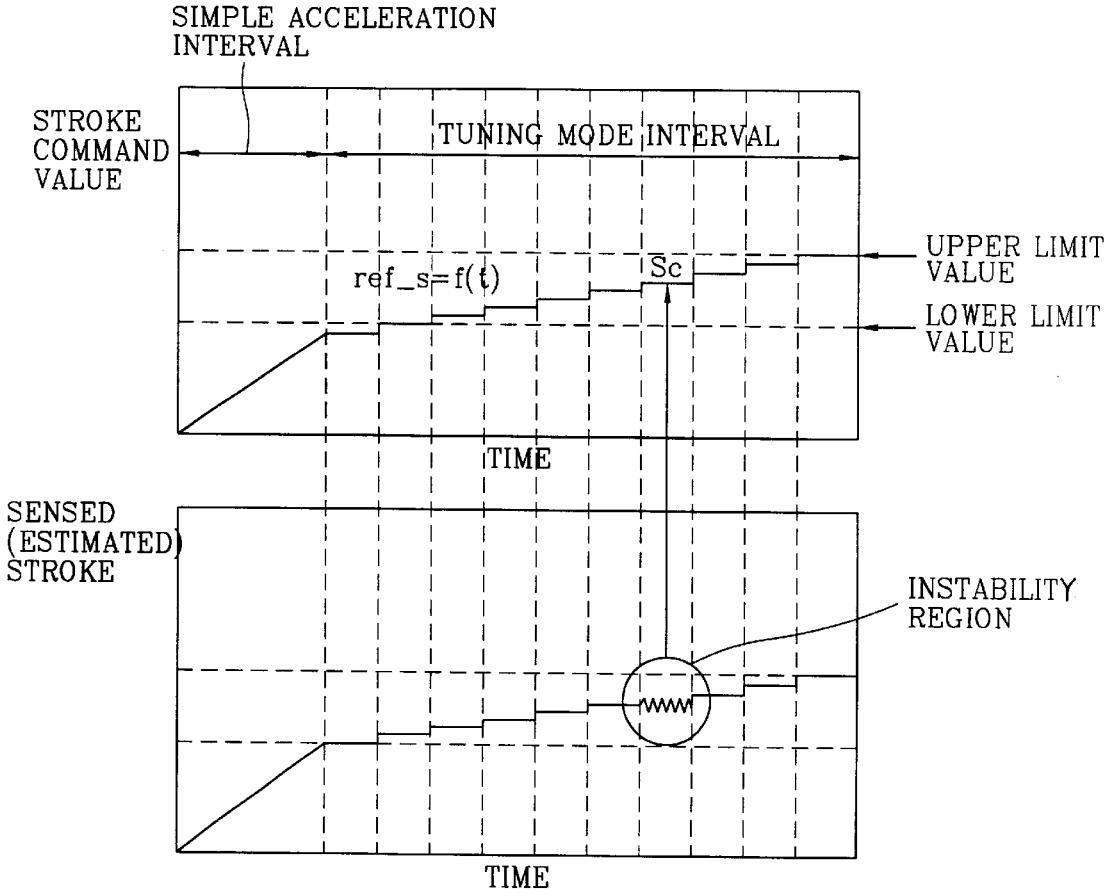
FIG. 17 is a view showing a process that a tuning instability region is sensed by a tuning point determiner of FIG. 7 in accordance with the present invention.

Upon receipt of it, if the information monitored by the instability monitoring unit 36 is in an unstable state, as shown in FIG. 17, the tuning point determiner 37 starts scanning from the lowest value LB of the stroke estimated by the sensorless stroke estimator 32. In this respect, even though there is parts deviation, since an instability point does not exist in the zone where the stroke is low, the scanning is started from the lower limit value LB for a quick scanning, and the stroke is simply accelerated from the zero point to the lower limit value.

Figure 18:
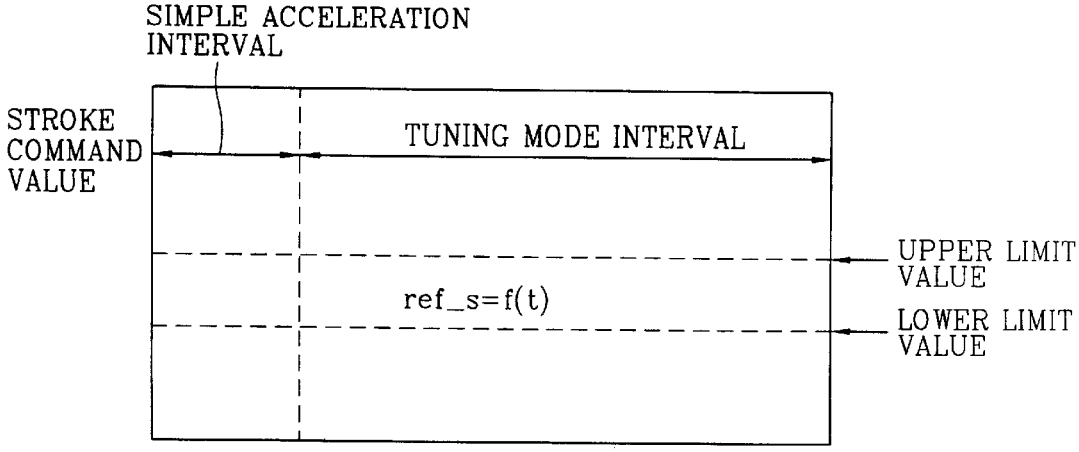
FIG. 18 is a view showing a process that a tuning instability region is sensed by the tuning point determiner by using a RAMP function of FIG. 7 in accordance with the present invention.

In order for certainty of the zone inspection, it is important to raise up the stroke command value slowly. For this purpose, the stroke command value is increased slowly by increasing the step. Otherwise, the RAMP function as shown in FIG. 18 may be used for the same purpose.

By scanning as described above, the stroke value is sensed at the interval where the tuning instability region occurs, and the sensed unstable stroke is provided to the stroke command value determiner 31.

Then, the stroke command value determiner 31 adds a relative value determined as a relative coordinate value for the cooling mode according to the temperature information inputted from an external source to the unstable stroke transferred by the tuning point determiner 37, and outputs thusly obtained value to the stroke controller 33 as a stroke command value.

Figure 13:
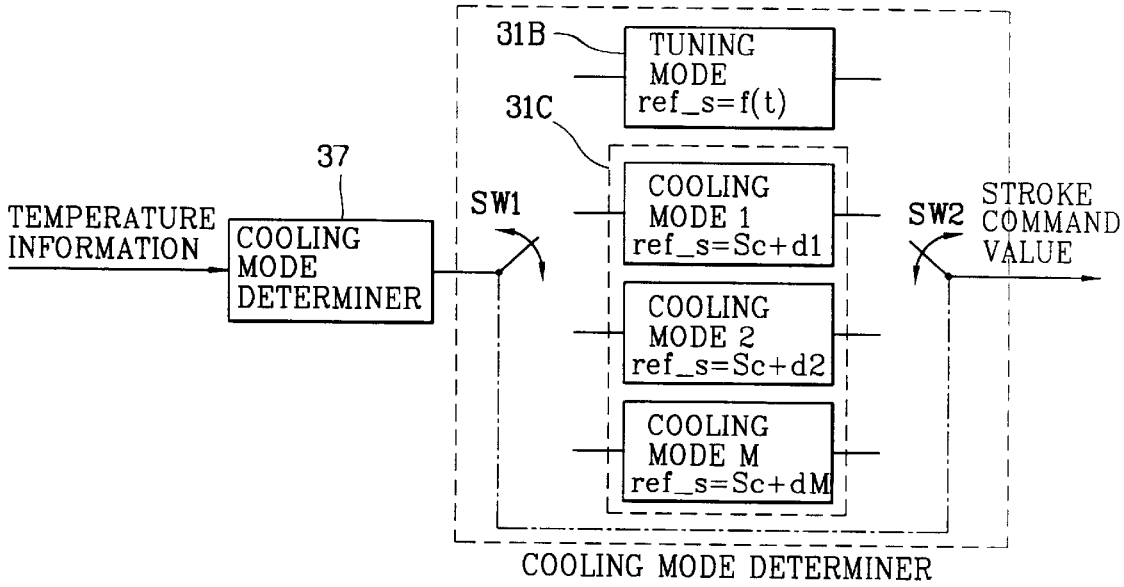
FIG. 13 is a detailed block diagram of the stroke command value determiner of FIG. 7 in accordance with the present invention.

In case that the result monitored by the instability monitoring unit 36 is a stable status, the tuning point determiner 37 does not provide the stroke estimated by the sensorless stroke estimator 32 to the stroke command value determiner 31. Then, the stroke command value determiner 31 outputs a stroke command value according to the stable state or the unstable state, which will now be described with reference to FIG. 13.

A cooling mode determiner 37 receives temperature information set by a user and judges whether is it an actuating mode or a cooling mode and outputs it accordingly.

In detail, in case that the result judged by the cooling mode determiner 37 is an actuating mode, the first switch SW1 is switched to a tuning mode controller 31B. The tuning mode controller 31B provided a stroke command value ref_s, upon changing it to ref_s=f(t), for driving the linear oscillating motor 10, to the stroke controller 33 through the second switch SW2.

In case that the result judged by the cooling mode determiner 37 is a cooling mode, a corresponding cooling mode is determined on the basis of the temperature information set by the user. Then, the cooling mode determiner 37 is connected to a corresponding cooling mode control unit C1-CM of a cooling mode control unit 31C through the first switch SW1.

As shown in FIG. 19, when the stroke is in a stable state, the cooling mode control unit C1-CM outputs a stroke command value according to an absolute coordinate method, while when the stroke is in an unstable state, it outputs a stroke command value obtained by a relative coordinate method.

That is, when the stroke is in the unstable state, outputs a stroke command value obtained by adding a threshold 'd' according to the cooling mode by the relative coordinate to the unstable stroke Sc provided by the tuning point determiner 38, to the stroke controller 33 through the second switch SW2.

In that manner, the stroke command value outputted from the cooling mode control unit C1-CM is determined by either the absolute coordinate method or the relative coordinate method depending on the stable state and the unstable state of the stroke, and thusly obtained stroke command value is provided to the stroke controller 33.

Upon receipt of the stroke command value from the cooling mode control unit, the stroke controller 33 adjusts the stroke command value determined by the stroke command value determiner 31 and the estimated stroke value to be identical to each other, and transfers the thusly obtained timer command value to the timer 35.

At this time, the zero-cross detector 34 receives the voltage V0 between the power supply voltage terminal and the current sensing resistance R of the electric circuit unit 20 or the voltage V4, the one before passing the capacitor C from the power supply voltage terminal, detects a zero-cross point, and provides the detected zero-cross signal to the timer 35.

When the zero-cross signal is received by the start terminal of the timer 35, the timer 35 sets a gate driving signal according to the timer command value provided by the stroke controller 33, and provides it to the gate terminal G of the triac Tr of the electric circuit unit 20.

Then, the triac Tr is turned on and a current is supplied to the linear oscillating motor 10, according to which the piston of the linear oscillating motor 10 moves upwardly and downwardly, thereby controlling the strength of the cooling air of the refrigerator or the air-conditioner.

A method for controlling an operation of the linear compressor in accordance with the present invention will now be described.

FIGS. 20A and 20B illustrate existence and nonexistence of a tuning instability region in the linear compressor depending on a suction side pressure and discharge side pressure of the linear compressor and an outer air temperature in accordance with the present invention.

Division of the interval where the tuning instability region exists is theoretically made by using an applied pressure.

The pressure can be detected directly, or detected by a temperature that is able to estimate a pressure.

The reason for having the two intervals, one where the tuning instability region exist and the other where the tuning instability region does not exist is as follows.

After the interval where the tuning instability region occurs is detected while the stroke voltage is being increased, in case that the linear compressor is operated by evading the tuning instability region, the stroke is kept increasing to search for a tuning instability region at the interval where there is no tuning instability region, In this respect, however, since the tuning instability region is not detected, the stroke is increased to the upper limit value, causing a danger by doing a damage on the discharge valve. For this reason, the linear compressor is operated by dividing the two intervals where the tuning instability region exists and where the tuning instability region does not exist.

FIG. 20A shows the interval where the tuning instability region exists and the interval where the tuning instability region does not exist as divided according to the discharge side pressure Pd and the suction side pressure Ps.

In detail, in the drawing, the left lower end portion and the right upper end portion marked with slant lines are the interval where there is no tuning instability region, while the middle portion without slant lines is the interval where there is a tuning instability region. The left lower end portion S1 with the slant lines has a discharge side pressure and a suction side pressure both lower than a predetermined pressure, of which outer air temperature is very low, while the right upper end portion has a discharge side pressure and a suction side pressure both higher than a predetermined pressure, of which outer air temperature is very high.

In case that the discharge side pressure and the suction side pressure are low, which falls on the case that the outer air temperature is low, the middle line of the movement of the piston of the linear compressor is moved toward the suction side, which does not require a strong cooling air, so that the piston is moved upwardly and downwardly with a short stroke.

Meanwhile, in case that both the discharge side pressure and the suction side pressure are high, which falls on the case that the outer air temperature is high, the middle line of the movement of the piston of the linear compressor is moved toward the discharge side, requiring a strong cooling air, so that the piston is moved upwardly and downwardly with a long stroke.

On the other hand, at the interval where the tuning instability region exists, having a discharge side pressure and a suction side pressure in the range between the high pressure and the low pressure, the piston searches for an optimal point and is moved accordingly (this will be described later).

Meanwhile, in case that the suction side pressure Ps is severely lowered down, such as the case where the door of the refrigerator using the linear compressor is opened, or its cooler is frosted, and thus, heat exchange is not made, the middle line of the movement of the piston moves toward the suction side. In consideration of this, the piston is moved with a short stroke, and then may be return to the former stroke when it turns to the normal state.

FIG. 20B illustrates the interval where the tuning instability region exists and the interval where the tuning instability region does not exist according to an outer air temperature. Compared to FIG. 20A in which the interval where the tuning instability region exists and the interval where the tuning instability region does not exist are judged by detecting the discharge side pressure and the suction side pressure, in FIG. 20B the interval where the tuning instability region exist and the interval where the tuning instability region does not exist are judged by detecting an outer air temperature of the compressor.

As described above, the most ideal way for judging the existence and nonexistence of the tuning instability region is based on the detection of the discharge and the suction side pressure of the compressor. In this respect, the detection by using the outer air temperature is easier way, having the same effect.

As shown in the drawing, the interval S1 where the outer air temperature is low (lower than t1) and the interval where the outer air temperature is high (higher than t2) are corresponded to the interval of FIG. 20A where the pressure is very low or very high, where the tuning instability region does not exist. Meanwhile, the interval where the outer air temperature is in the middle range (between t1 and t2) is corresponded to the interval of FIG. 20A where the pressure is adequate, where the tuning instability region exists.

Figure 21:
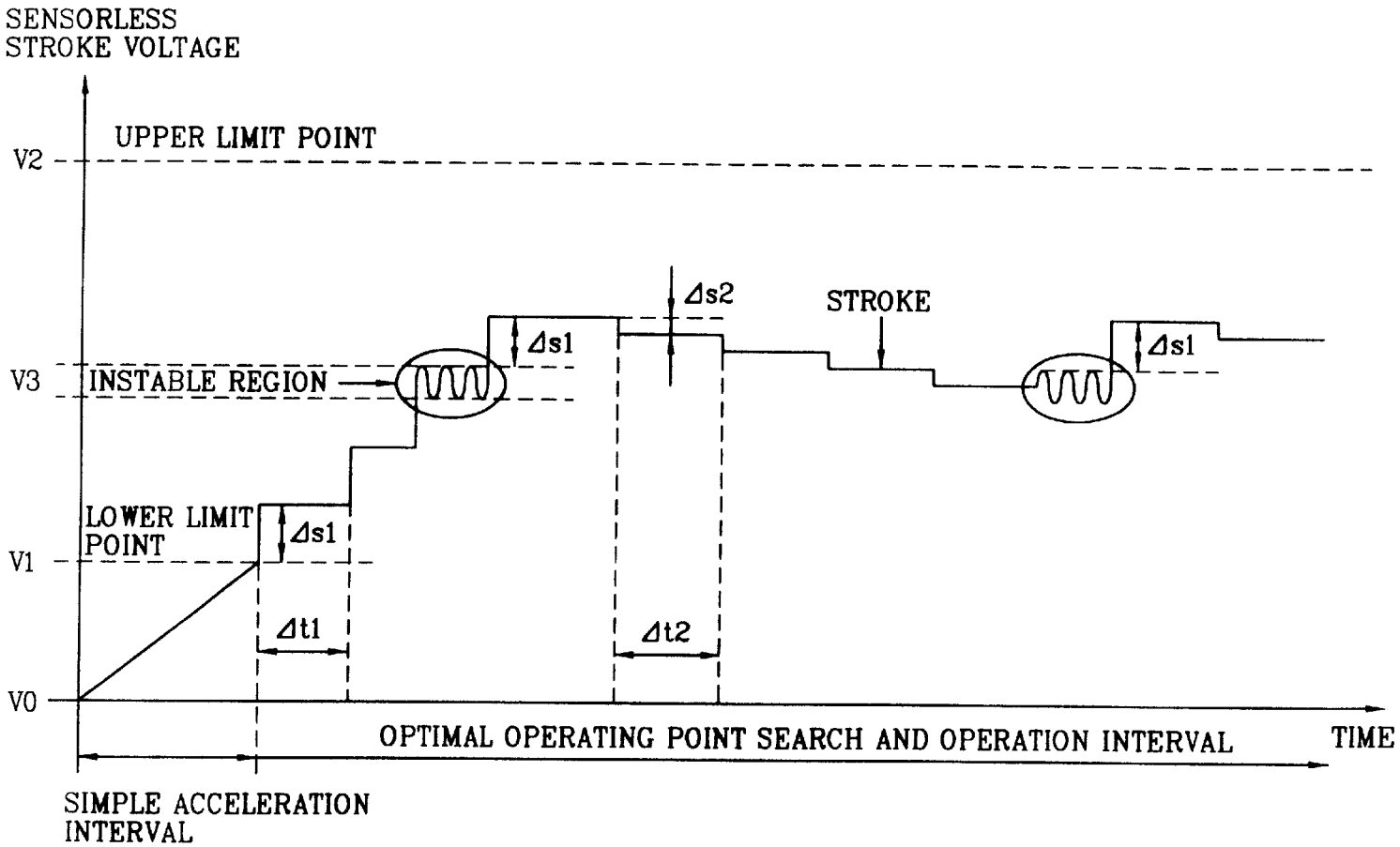
FIG. 21 illustrates searching for an optimal operation point of the linear compressor and an operational algorithm in accordance with the present invention.

FIG. 21 illustrates searching for an optimal operation point of the linear compressor and an operational algorithm in accordance with the present invention. That is, an algorithm is shown that the tuning instability region is searched at the interval where the tuning instability region exists of FIGS. 21A and 21B, and the linear compressor is operated by evading the tuning instability region. As shown in this drawing, scanning for searching the tuning instability region is started from the low limit point V1 of the stroke estimated by the sensorless stroke estimator. This is to speedify the scanning because there is no tuning instability region even though there is parts deviation in the region having short stroke.

Accordingly, scanning is simply accelerated from the starting point V0 to the low limit point V1. After the simple acceleration, when the stroke reaches the low limit point V1, the stroke is increased by $\Delta s1$ by time unit, thereby searching for the interval where the tuning instability region exists. While keeping increasing the stroke by $\Delta s1$, if the tuning instability region is searched, the stroke is increased by $\Delta s1$ and the stroke at this time is kept as it is. The reason for this is that an experiment disclosed that there is the least noise in the very upper portion of the tuning instability region.

The tuning instability region has a tendency of moving as time goes by. Therefore, in order to maintain the optimal stroke, the movement of the tuning instability region needs to be successively traced, so that the stroke can be maintained at the very upper portion of the tuning instability region which is changed on occasion. For this purpose, it is continuously searched whether there occurs any tuning instability region in the current stroke until a predetermined time $\Delta t2$ lapses. Upon searching, if there is a tuning instability region in the current stroke, the stroke is again increased by $\Delta s1$. This process is repeated until the tuning instability region is evaded.

While the stroke is being maintained at the very upper portion of the tuning instability region, if no tuning instability region occurs even after the predetermined time $\Delta t2$ lapses, the stroke is decreased by $\Delta s2$, and it is again searched whether there is any tuning instability region. At this time, if any tuning instability region is detected, the stroke is again increased by $\Delta s1$, so that the stroke can be placed at the very upper portion of the tuning instability region.

If no tuning instability region is detected even after the stroke is decreased by $\Delta s2$, it is judged that the tuning instability region is much moved downwardly, according to which the stroke is kept decreasing by $\Delta s2$ by $\Delta t2$ time unit.

And then, if any tuning instability region is detected, the stroke is increased as much as Δs1, so that the compressor can be operated at the very upper portion of the tuning instability region, thereby maintaining the optimal operation state.

Figure 22:
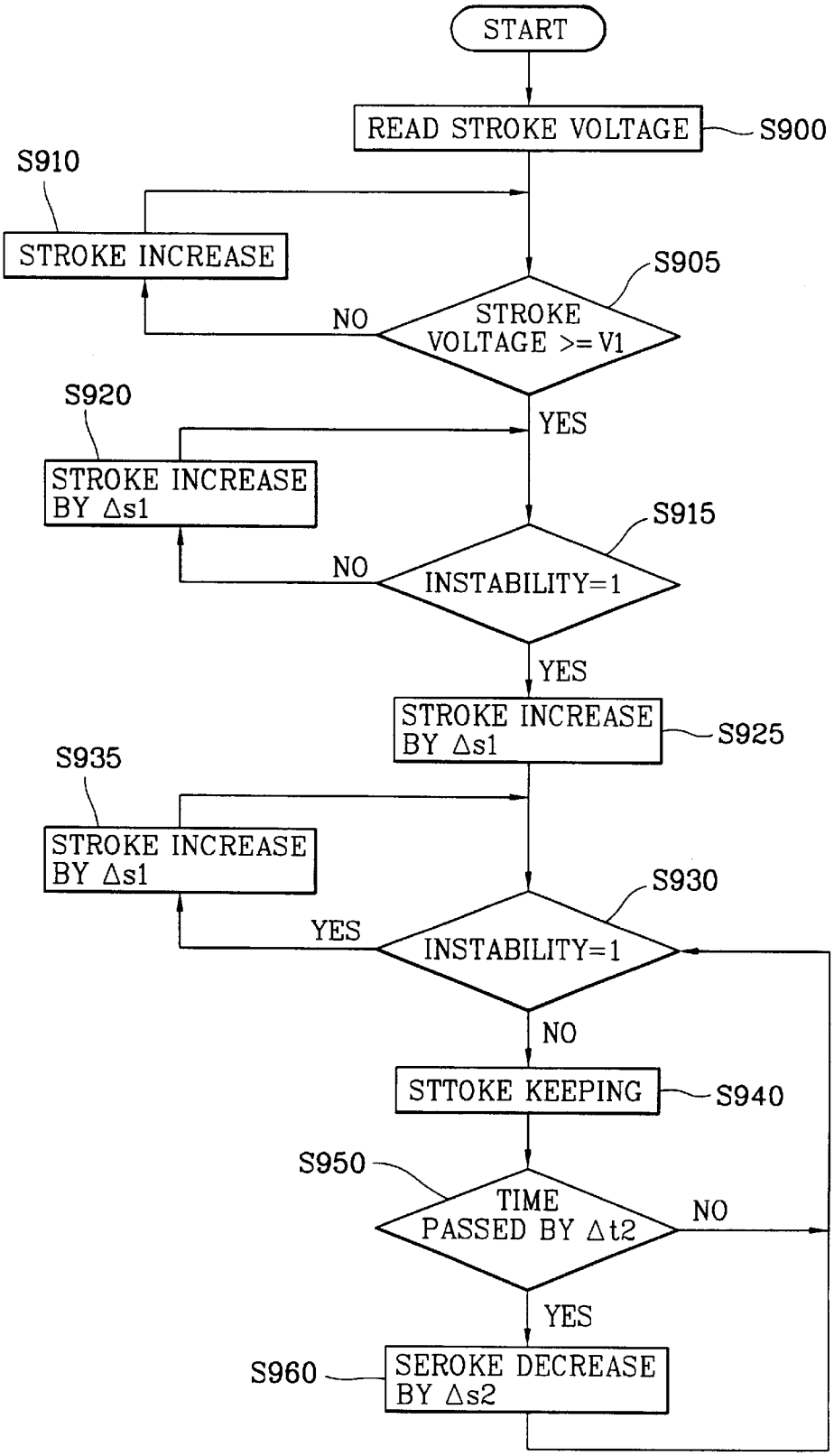
FIG. 22 is a flow chart of searching for an optimal operation point of the linear compressor and an operational algorithm in accordance with the present invention.

FIG. 22 is a flow chart of searching for an optimal operation point of the linear compressor and an operational algorithm in accordance with the present invention.

When the linear compressor is started to be operated, a stroke voltage is read by the sensorless stroke estimator of the linear compressor in a step S900. As described above, since the operation range of the compressor also includes the interval where the tuning instability region does not exist, it would be a time consumption if such an interval is also included for scanning in searched for the tuning instability region.

For this reason, the tuning instability region is searched from the low limit point V1 of the stroke estimated by the sensorless stroke estimator, for which it is judged whether the stroke voltage is more than the low limit point V1 in a step S905.

If the stroke voltage has not reached the low limit point, searching for the tuning instability region is not performed and only the stroke voltage is continuously increased and the scanning is speedified in a step S910.

When the stroke voltage reaches the low limit point V1 after passing the simple acceleration, searching is started whether any tuning instability region exists in a step S915. If no tuning instability region is detected, it is judged that the tuning instability region exists at a portion upper than the current stroke voltage, and accordingly, the stroke voltage is increased by Δs1 in a step S920. And then, searching is performed whether there is any tuning instability region at the increased stoke voltage in a step S915. This process is repeatedly performed and the stroke voltage is kept increasing until the tuning instability region is detected.

In the step 915, if the tuning instability region is detected, the stroke voltage is increased by Δs1 in a step 925. And, searching is performed as to whether there is any tuning instability region in the step S930, and if no tuning instability region is detected, the stroke voltage is again increased by Δs1 in a step S935. Then, searching is again performed as to whether there is any tuning instability region. This process is repeatedly performed until no tuning instability region is detected.

If the tuning instability region is not detected any more in the step S930, the stoke voltage at that time is maintained for operation in a step S940. In this manner, the stroke voltage is always placed at the very upper portion of the tuning instability region, so that the linear compressor can be operated stably and efficiently, with little noise.

However, while it is being continuously operated, the tuning instability region can be changed occasionally. In view of an optimal operation, the tuning instability region needs to be kept tracing, so that the stroke can be controlled at the very upper portion of the tuning instability region. For this purpose, while a stoke voltage is constantly maintained, it is detected as to whether there exists a tuning instability region at the current stroke voltage. That is, currently, the linear compressor is being operated at a state that the stroke voltage is increased as much as Δs1 higher than the tuning instability region, and in this state, it is detected as to whether the tuning instability region is again increased as much as Δs1. At this time, the time is set by Δt2, and it is continuously detected as to whether there is any tuning instability region until the set time lapses. If there exists a tuning instability region in the time period of Δt2, the stroke voltage is increased by Δs1 in a step S935, while if there is no tuning instability region for the time period of Δt2, it is judged that the tuning instability region was moved downwardly from the already detected region, so that the stroke voltage is decreased by Δs2 in a step S960.

After the stroke voltage is decreased as much as Δs2, it is again detected as to whether there is any tuning instability region in the step S930. And, if there is a tuning instability region, it is judged that the tuning instability region did not move downwardly even after the predetermined time Δt2 lapses, according to which the stroke voltage is increased by Δs1 in the step S935, and this process is repeatedly performed so that the linear compressor can be operated at the very upper portion of the tuning instability region.

On the other hand, after the stroke voltage is decreased as much as s2A and the tuning stability is searched, if there is no tuning instability region, it is judged that the tuning instability region was moved downwardly. Then it is judged that the tuning instability region is moved upwardly until a predetermined time Δt2 lapses while the stroke voltage at the time is maintained.

If a tuning instability region is detected within the predetermined time Δt2, the stroke voltage is increased so that the tuning instability region is evaded, while if no tuning instability region is detected within the predetermined time Δt2, it is judged that the tuning instability region was moved downwardly, so that the stroke voltage is decreased by Δs2 for operation in the step S960. By repeatedly performing the process, the stroke of the linear compressor is always placed at the very upper portion of the tuning instability region, the linear compressor can be operated stably with little noise.

Figure 23:
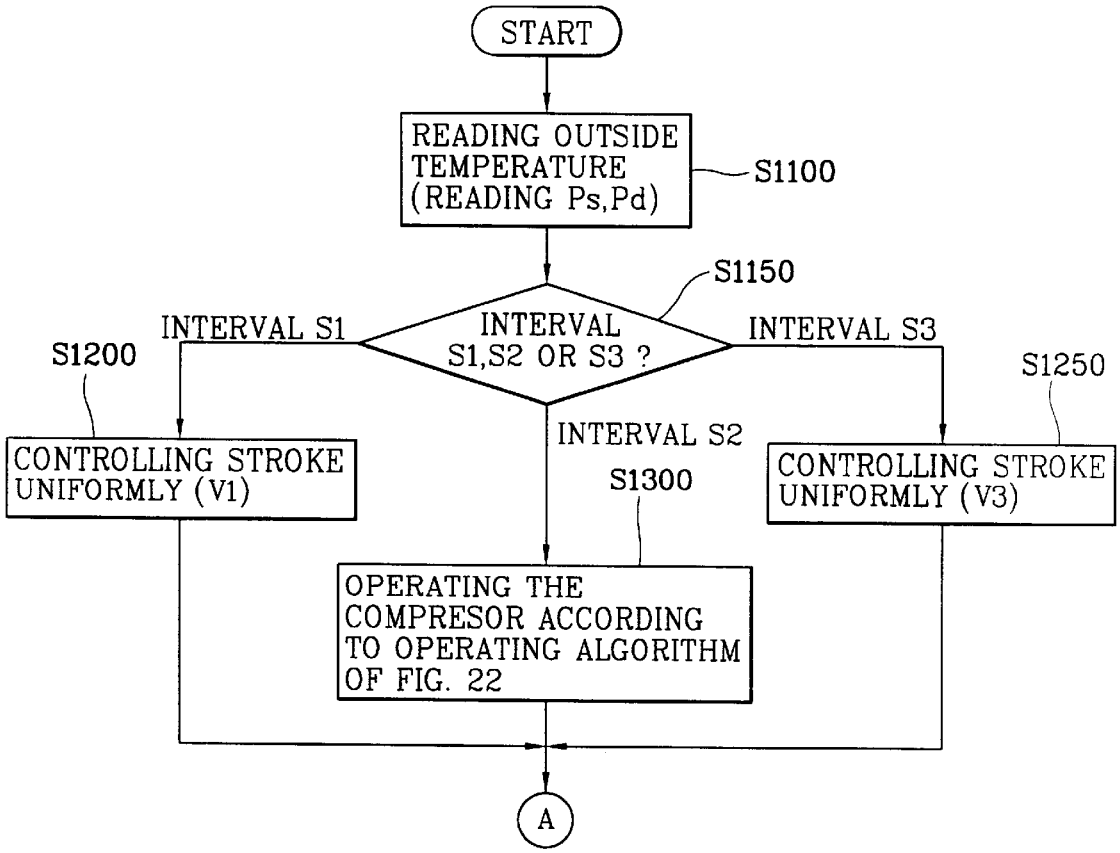
FIG. 23 is a flow chart of an operational algorithm by intervals according to existence and nonexistence of an instability region in the linear compressor in accordance with the present invention.

FIG. 23 is a flow chart of an operational algorithm by regions according to existence and nonexistence of an instability region in the linear compressor in accordance with the present invention. The flow chart shown in this drawing refers to an embodiment for the linear compressor adopted for the refrigerator; nevertheless, it may be applied to other appliances such as an air-conditioner.

For an optimal operation, first an outer air temperature of the compressor is read in a step S1100. The reason for this is to estimate the discharge side pressure Pd and the suction side pressure Ps of the compressor. In this step, the discharge side pressure and the suction side pressure may be directly detected.

Upon reading the outer air temperature in the step S1110, there are two intervals as divided, of which one interval S1 and S3 where the tuning instability region does not exist and the other interval S2 where the tuning instability region exists in a step S1150.

According to division, at the interval S1 having a low outer air temperature (lower than the temperature t1), since the tuning instability region does not occur, the linear compressor is operated by controlling at a constant stroke voltage V1 in a step S1200.

Also, after the outer air temperature is detected in the step S1150, since the tuning instability region does not occur at the interval S3 having a high outer air temperature (higher than the temperature t2), the linear compressor is operated by controlling at a constant stroke voltage V3 in a step S1250.

Meanwhile, at the interval S2 having a middle outer air temperature (the temperature between t1 and t2), the optimal operatiing point is searched and the linear compressor is accordingly operated with an operation algorithm in a step S1300.

As described, since the linear compressor is operated by having two intervals as divided according to existence or nonexistence of the tuning instability region, the tuning instability region is evaded for operation, so that a stable operation can be accomplished with little noise during the normal operation.

In this connection, however, in case of the refrigerator, during the normal operation, the door of the refrigerator may be opened or its cooler may be frosted. Then, the heat change is not made, which leads to a rapid dropping in the temperature of the cooler, causing that the operation becomes unstable or a noise is generated. When such an abnormal state occurs, since the suction side pressure Ps becomes very low, the middle line of the movement of the piston of the compressor moves toward the suction side. In this case, the piston is operated to have a short stroke. Thereafter, when the normal state is restored, the piston is operated to have the former stroke.

Figure 24:
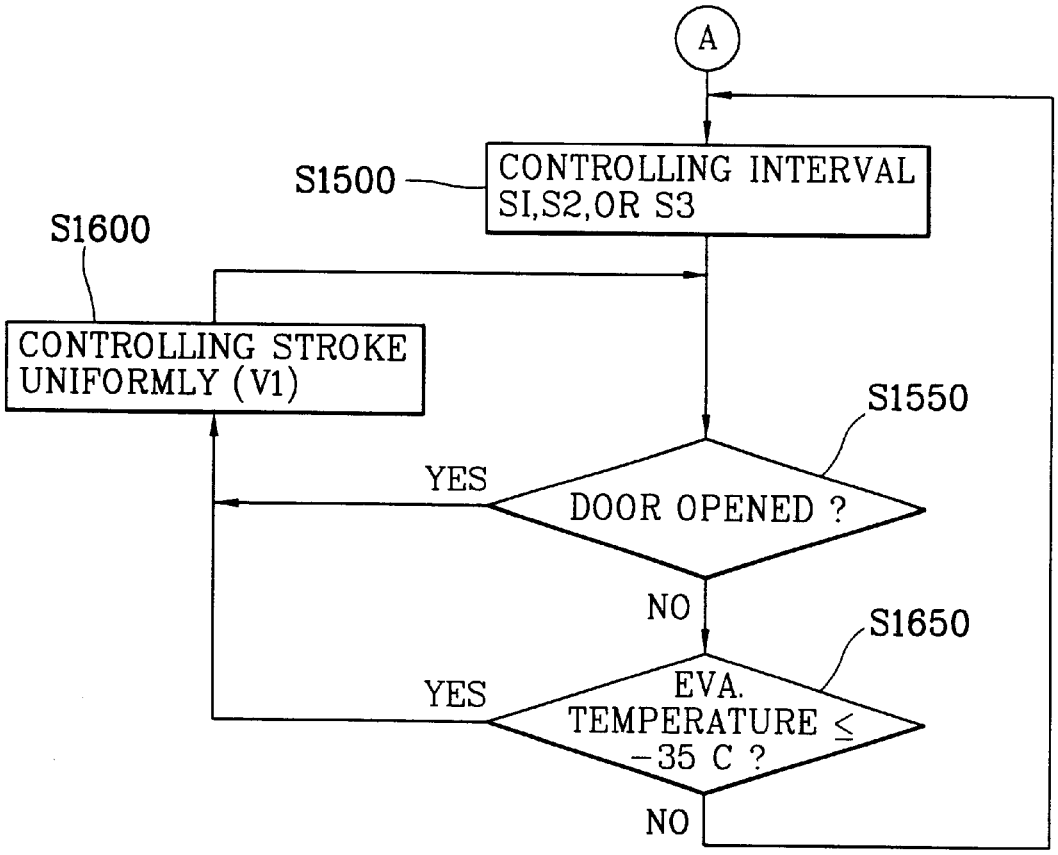
FIG. 24 is a flow chart of an operational algorithm when an abnormality occurs while the linear compressor is being operated.

FIG. 24 is a flow chart of an operational algorithm when an abnormality occurs while the linear compressor is being operated.

The stroke is controlled according to the interval S1, S2 or S3 depending on the outer air temperature in a step S1500. During controlling the stroke, it is judged whether the door of the refrigerator is opened in the step S1550. If the door of the refrigerator is not opened, the next step is followed and it is detected whether the temperature of the cooler is the ultra low temperature.

If it is judged that the door of the refrigerator is opened in the step S1550, the stroke is controlled to be short, that is, V1, regardless of that at which interval the stroke was being controlled in a step S1600. Thereafter, is it continuously detected as to whether the door of the refrigerator is opened in the step S1550. This detecting process is repeatedly performed until the door of the refrigerator is closed.

After the door of the refrigerator is closed, it goes back to the step S1650, in which it is detected whether the temperature of the cooler was dropped down to an ultra low temperature, i.e., below −35° C., considering that when the cooler is frosted, heat exchange is not made. Upon detection, if there is no problem with the cooler, that is, the temperature of the cooler is more than a predetermined value, it is judged that the abnormal state was ended, and it returns to the original stroke control state in the step S1500.

However, if there is a problem with the cooler in the step S1650, and thus, the heat exchange is not made, the stroke is controlled to be short, that is, V1, regardless of the former stroke control state in the step S1600. Thereafter, the steps S1550 and S1650 are repeated to judge whether the abnormal state was ended. If the abnormal state was ended, the stroke is returned to the original state S0 as to be controlled according to the interval S1, S2 or S3 in the step S1500.

In the embodiment described above, the description on the control controlling in the case that the door of the refrigerator is opened was first made; nonetheless, the case that there first occurs a problem with the cooler or the case that problems occur simultaneously with both the door and the cooler, the stroke can be controlled in the same manner according to the flow chart of the drawing.

As so far described, according to the apparatus and method for controlling the linear compressor of the present invention, when the tuning instability occurs due to the characteristic deviation and the assembly deviation of the mechanic unit of the compressor, and the parts deviation in the control circuit such as the sensorless stroke estimator, the compressor deviation is corrected by using a relative coordinate value.

And, while the linear compressor is being operated with the stroke command value according to the cooling mode, in case that the current stroke is in an unstable state, the stroke command value is lowered down as much as a predetermined value, with which the linear compressor is operated for a predetermined time.

Then, when a predetermined time lapses, it is operated with the original stroke command value, thereby evading the unstable state. In addition, the tuning instability region is searched for depending on the discharge side pressure and the suction side pressure of the compressor or the outer air temperature while the linear compressor is being operated, in order to avoid it, thereby accomplishing the optimal operation of the linear compressor.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the meets and bounds of the claims, or equivalence of such meets and bounds are therefore intended to be embraced by the appended claims.

What is claimed is:

1. In an apparatus for automatically correcting a deviation of a linear compressor having an electric circuit unit for controlling an alternate current power source according to a gate driver signal to vary a stroke, thereby controlling the power applied to a linear oscillating motor that controls the strength of cooling air, and a control unit for outputting a gate drive signal to render a stroke command value according to temperature information to be identical to a stroke estimated by a stroke voltage applied to the linear oscillating motor, the control unit comprising:

a cooling mode determiner for determining a cooling mode according to inputted temperature information;

a sensorless stroke estimator for receiving stroke voltages supplied to the linear oscillating motor; estimating a stroke value and current information, and outputting the estimated stroke value and the current information;

an instability monitoring unit for monitoring whether an instability occurs by using the stroke value and the current information outputted from the sensorless stroke estimator, and outputting the monitored information;

a stroke command value determiner for determining a proper stroke command value in consideration of an overall situation from the cooling mode determined by the cooling mode determiner and from the information on the occurrence of the instability as outputted by the instability monitoring unit;

a stroke controller for adjusting the stroke estimated by the sensorless stroke estimator to fit well the stroke command value determined by the stroke command value determiner, and accordingly outputting a timer command value;

a zero-cross detector for detecting a zero-cross point from an inputted voltage waveform and outputting a zero-cross signal; and a timer for providing a gate drive signal according to the value estimated by the stroke controller to the time point when the zero-cross signal is outputted from the zero-cross detector.

2. A method for controlling a linear compressor comprising the steps of:

setting a stroke command value corresponding to a cooling mode command value;

checking whether or not a timer is driven;

checking a current state of instability of the stroke if the timer is not driven;

operating the linear compressor for a predetermined time by lowering down the set stroke command value as much as a predetermined value if the stroke is in an unstable state, while operating the linear compressor according to the stroke command value as set, if the stroke is in a stable state; and returning the currently driven stroke command value to an original stroke command value so as to operate the linear compressor when a corresponding time lapses after the timer is driven.

3. A method for controlling a linear compressor comprising the steps of:

setting a stroke command value corresponding to a cooling mode command value;

checking whether the stroke is in an unstable state or in a stable state;

lowering down the stroke command value as much as a predetermined value to operate the linear compressor for a predetermined time if the stroke is in an unstable state;

checking whether or not the time is driven, if the stroke is in a stable state; and outputting the stroke command value as set in the step S1 if the timer was not driven, while returning the currently driven stroke command value to an original stroke command value when a corresponding time lapses after the timer is driven.

4. In an apparatus for automatically correcting a deviation of a linear compressor having an electric circuit unit for controlling an alternate current power source according to a gate driver signal to vary a stroke, thereby controlling the power applied to a linear oscillating motor that controls the strength of cooling air, and a control unit for outputting a gate drive signal to render a stroke command value according to temperature information to be identical to a stroke estimated by a stroke voltage applied to the linear oscillating motor, the control unit comprising:

a sensorless stroke estimator for receiving stroke voltages supplied to the linear oscillating motor, estimating a stroke value and current information to output them; an instability monitoring unit for monitoring whether the current stroke is in an unstable state or in a stable state upon receipt of the information from the sensorless stroke estimator;

a tuning point determiner for determining a tuning point from the stroke value estimated by the sensorless stroke estimator and outputting it, if it receives information about instability from the instability monitoring unit; a stroke command value determiner for determining a stroke command value by using temperature information from an external source and the tuning point determined by the tuning point determiner;

a stroke controller for adjusting the stroke estimated by the sensorless stroke estimator to fit well the stroke command value determined by the stroke command value determiner, and accordingly outputting a timer command value;

a zero-cross detector for detecting a zero-cross point from an inputted voltage waveform and outputting a zero-cross signal; and a timer for providing a gate drive signal according to the value estimated by the stroke controller to the time point when the zero-cross signal is outputted from the zero-cross detector.

5. The apparatus according to claim 4, wherein the stroke command value determiner of the apparatus for automatically correcting a deviation of a linear compressor includes:

a cooling mode determiner for judging whether it is an actuating state or a cooling state according to inputted temperature information and determining whether a tuning mode is to be selected or a cooling mode is to be selected;

a first switch for switching to a corresponding mode according to an output from the cooling mode determiner;

a tuning mode controller for outputting a stroke command value for tuning in case that the actuating mode is judged by the cooling mode determiner;

a cooling mode control unit for correcting a stroke command value according to the first, the second, . . . the nth cooling mode by using a relative coordinate value and outputting the corrected stroke command value, in case that the cooling mode is judged by the cooling mode determiner and the current stroke is in an unstable state; and a second switch for providing the stroke command values respectively outputted from the tuning mode controller and the cooling mode control unit to the stroke controller.

6. The apparatus according to claim 4, wherein the tuning point determiner of the apparatus for automatically correcting a deviation of the linear compressor determines a tuning point by scanning the stroke estimated by the sensorless stroke estimator while increasing it step by step.

7. The apparatus according to claim 4, wherein the tuning point determiner of the apparatus for automatically correcting a deviation of the linear compressor determines the tuning point by scanning the stroke estimated by the sensorless stroke estimator by using a slow RAMP function.

8. A method for controlling an operation of a linear compressor including the steps of:

setting both intervals where a tuning instability region exists and where a tuning instability region does not exist depending on a discharge side pressure and a suction side pressure of the compressor or an outer air temperature; and controlling an oscillating motor with a lowly or a highly predetermined stroke voltage at the interval where a tuning instability region does not exist, while detecting a tuning instability region and maintaining a stroke voltage at the very upper portion of the tuning instability region at the interval where a tuning instability region exists for operation of the linear compressor.

9. The method according to claim 8, wherein the intervals where the discharge side pressure Pd and the suction side pressure Ps of the compressor are all below a predetermined pressure and where the discharge side pressure Pd and the suction side pressure Ps of the compressor are all beyond a predetermined pressure are set as intervals where the tuning instability region does not exist, while the interval placed between the two intervals is set as an interval where the tuning instability region exists.

10. The method according to claim 8, wherein the linear compressor, both the temperature level where an outer air temperature of the compressor is low below a predetermined temperature and the temperature level where the outer air temperature of the compressor is high beyond a predetermined temperature are set as intervals where the tuning instability region does not exist, while a temperature level between the above two temperature levels is set as an interval where the tuning instability region exists.

11. The method according to one of claims 8 to 10, wherein the oscillating motor is controlled at a high or low constant stroke voltage at the interval where the tuning instability region does not exist, while it is controlled by varying the stroke voltage after detecting an optimal point at the interval where the tuning instability region exists.

12. The method according to claim 10, wherein at the interval where the tuning instability region exists, the tuning instability region is searched for by increasing the stroke voltage value from the lowest point of the stroke by predetermined voltage values, and when the tuning instability region is detected, a predetermined voltage value is again increased so as to constantly maintain the stroke voltage at the very upper portion of the tuning instability region, and then, after a predetermined time lapses, the tuning instability region is again search for by reducing the stroke voltage value by predetermined values, and when the tuning instability region is detected, the stroke voltage value is again increased, according to which the optimal operating point to be placed at the very upper portion of the tuning instability region.

13. The method according to claim 12, wherein the oscillating motor is simply accelerated until the stroke voltage value reaches the lower limit value from a zero value, to thereby reduce a searching time.

14. The method according to claim 11, wherein in case that an abnormal state occurs while the oscillating motor is being controlled at a constant stroke voltage or a varying stroke voltage, the stroke is controlled to be short, and then, when the normal state is restored, it returns to the previous stroke.

* * * * *